US010258159B2

(12) United States Patent
Costaglia

(10) Patent No.: US 10,258,159 B2
(45) Date of Patent: Apr. 16, 2019

(54) TILT MECHANISM FOR A SEATING FURNITURE AND SEATING FURNITURE INCLUDING THE SAME

(71) Applicant: L&P PROPERTY MANAGEMENT COMPANY, South Gate, CA (US)

(72) Inventor: Massimo Costaglia, Santa Giustina in Colle (IT)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 120 days.

(21) Appl. No.: 15/112,645

(22) PCT Filed: Oct. 30, 2014

(86) PCT No.: PCT/EP2014/073323

§ 371 (c)(1),
(2) Date: Jul. 19, 2016

(87) PCT Pub. No.: WO2015/106847

PCT Pub. Date: Jul. 23, 2015

(65) Prior Publication Data

US 2016/0331137 A1 Nov. 17, 2016

(30) Foreign Application Priority Data

Jan. 20, 2014 (EP) ..... 14151715

(51) Int. Cl.
*A47C 1/032* (2006.01)
*A47C 11/00* (2006.01)
*A47C 31/12* (2006.01)

(52) U.S. Cl.
CPC ..... *A47C 1/03272* (2013.01); *A47C 1/03255* (2013.01); *A47C 11/005* (2013.01); *A47C 31/126* (2013.01)

(58) Field of Classification Search
CPC . A47C 1/03255; A47C 1/03272; A47C 7/443; A47C 11/005; A47C 31/126
(Continued)

(56) References Cited

U.S. PATENT DOCUMENTS 3,337,267 A 8/1967 Rogers, Jr.
4,761,033 A 8/1988 Lanuzzi et al.
(Continued)

FOREIGN PATENT DOCUMENTS

DE 202005011725 U1 12/2006
EP 2389840 A1 11/2011

OTHER PUBLICATIONS

International Search Report with Written Opinion dated Jan. 28, 2015 in Application No. PCT/EP2014/073323, 7 pages.
(Continued)

*Primary Examiner* — Theodore V Adamos
(74) *Attorney, Agent, or Firm* — Shook, Hardy & Bacon L.L.P.

(57) ABSTRACT

A tilt mechanism for a weight-responsive seating furniture comprises a backrest support, a first lever and a second lever. The backrest support is configured for coupling to a backrest and is pivotably mounted. The first lever has a mount structure for coupling the first lever to a seat. The first lever is pivotably mounted at a first pivot axis. The second lever is pivotably attached to the backrest support at a second pivot axis and is coupled to the first lever by a coupling mechanism to pivot the first lever about the first pivot axis when the backrest support pivots relative to the carrier.

13 Claims, 16 Drawing Sheets

(58) Field of Classification Search
USPC .... 297/285, 293, 294, 295, 296, 299, 300.1, 297/300.2, 300.5, 300.6, 302.1, 302.4, 297/316, 317, 319, 325, 340, 341, 342, 297/344.1, 344.14
See application file for complete search history.

(56) References Cited

U.S. PATENT DOCUMENTS 4,966,411 A * 10/1990 Katagiri ..... A47C 1/0325 297/300.3
5,141,284 A * 8/1992 LaPointe ..... A47C 1/0352 297/325
5,150,948 A * 9/1992 Volkle ..... A47C 1/03255 297/300.5
5,308,144 A * 5/1994 Korn ..... A47C 1/03255 297/300.2
5,573,303 A * 11/1996 Doerner ..... A47C 1/03255 297/300.5
5,582,459 A * 12/1996 Hama ..... A47C 1/03255 297/285
5,964,503 A * 10/1999 Inoue ..... A47C 1/03255 297/300.1
6,000,755 A * 12/1999 Uhlenbrock ..... A47C 1/03255 297/300.2
6,234,573 B1 * 5/2001 Roder ..... A47C 1/03238 297/300.5
2009/0146476 A1 * 6/2009 Kan ..... A47C 1/03255 297/284.4
2014/0028068 A1 * 1/2014 Birkbeck ..... A47C 1/022 297/340

OTHER PUBLICATIONS

European Office Action dated Nov. 8, 2016 in European Patent Application No. 14151715.1, 6 pages.

* cited by examiner

TILT MECHANISM FOR A SEATING FURNITURE AND SEATING FURNITURE INCLUDING THE SAME

FIELD OF THE INVENTION

The invention relates to a tilt mechanism for a seating furniture, e.g. a chair. The invention relates in particular to a tilt mechanism for a chair or another seating furniture which is weight-responsive.

BACKGROUND OF THE INVENTION

For a wide variety of applications, chairs and other types of seating furniture are nowadays provided with features which provide enhanced comfort to the person using the chair. For illustration, office-type chairs are commonly utilized in modern working environments to provide an occupant with a level of comfort while performing certain tasks that require a person to be in a seated position for an extended period of time. Similar features may be provided in other types of chairs to provide enhanced comfort to the person sitting on the chair.

One common configuration for such a chair includes a chair base assembly and a superstructure. The superstructure may include components which enable the user to recline or "tilt" the backrest of the chair. This basic chair configuration allows users to change their sitting position in the chair as desired, such that fatigue may be minimized during long sitting periods.

In recent years, chair designs have implemented a feature where the recline characteristics of a chair backrest may be altered. For illustration, the force applied by the chair backrest during a recline motion may be varied, so as to better accommodate the needs of different users. Adjusting elements may be provided on the chair which allow a user to manually adjust the force applied by the chair backrest. Alternatively or additionally, weight-responsive chairs may be provided with a mechanism in which the force applied by the chair backrest during a recline motion depends on a weight of a person sitting on a seat of the chair.

Such tilt mechanisms for weight-responsive chairs are typically designed with a central body fixed under the seat of the chair and are typically fixed exclusively on a gas column. The body of the tilt mechanism may therefore generally be visible, even if in some cases it may be fairly small. Such conventional tilt mechanisms for weight-responsive chairs are designed mainly to be used in the field of office chairs. Their overall dimensions and the fact that they are built to be fixed on a gas column complicate their application in other types of chairs. For illustration, when the seat of the chair is formed by an elastic membrane, it may be difficult or nearly impossible to use a conventional tilt mechanism which provides weight-dependent recline forces on such a chair.

BRIEF SUMMARY OF THE INVENTION

There is a continued need in the art for a tilt mechanism and a seating furniture which address some of the above needs. In particular, there is a continued need in the art for a tilt mechanism which is versatile and can be used in seating furniture having different base assemblies, while providing a weight-dependent force to the seat occupant. There is a need for such a tilt mechanism which has a compact design at least in a lateral direction of the seat.

According to an embodiment, a tilt mechanism is provided. The tilt mechanism comprises a backrest support configured for coupling to a backrest which is pivotably mounted. The tilt mechanism comprises a first lever having a mount structure for coupling the first lever to a seat. The first lever is mounted to be pivotable about a first pivot axis. The tilt mechanism comprises a second lever pivotably attached to the backrest support at a second pivot axis. The second lever is coupled to the first lever by a coupling mechanism to pivot the first lever about the first pivot axis when the backrest support pivots.

The coupling mechanism may comprise a pivot axis which pivotably couples the second lever to the first lever.

The tilt mechanism may further comprise a slot to limit travel of the seat. The slot may be formed in the backrest support. The slot may be formed on a carrier on which the backrest support and the first lever are pivotably mounted.

The tilt mechanism may further comprise a projection slideably received in the slot and configured to travel along the slot when the backrest support pivots. Abutment of the projection against an end of the slot may define an end position of a seat travel.

The slot which limits travel of the seat may be formed on the backrest support. The slot which limits travel of the seat may be formed on a carrier to which the first lever is pivotably mounted.

The slot may extend at a distance from the first pivot axis.

The tilt mechanism may further comprise a third lever having a further mount structure for coupling the third lever to the seat.

The third lever may be provided such that it is not attached to the first lever and the second lever.

The tilt mechanism may be configured to allow a seat coupled to the first lever to be flipped up. The further mount structure for coupling the third lever to the seat may be configured to allow the seat to pivot about the further mount structure. The mount structure which couples the seat to the first lever may be configured such that it does not prevent the seat from pivoting about the further mount structure. This allows the seat to be folded up. A weight-responsive tilt mechanism which may be used in association with a foldable seat may be used for various applications. It may be desirable to fold up seats to keep corridors clear of the seats, e.g. in cinemas. It may be desirable to fold up seats to facilitate horizontal nesting of chairs for storage purposes, for example.

The first lever and the third lever may be positioned such that, when the tilt mechanism is installed in a chair, the first lever attaches to the seat at a first location which is located forward of a second position at which the third lever attaches to the seat.

The first lever may be positioned on the tilt mechanism such that, when the tilt mechanism is installed in a chair, the mount structure of the first lever is positioned rearward and upwardly of the first pivot axis. The first lever may be positioned on the tilt mechanism such that, when the tilt mechanism is installed in a chair, the mount structure of the first lever moves forwardly and upwardly as the backrest support is reclined.

The third lever may be positioned on the tilt mechanism such that, when the tilt mechanism is installed in a chair or other seating furniture, the mount structure of the third lever is positioned rearward and upwardly of the third pivot axis at least when the backrest is not reclined.

The tilt mechanism may further comprise an energy storage mechanism which biases at least one of the second lever and the backrest support. The energy storage mechanism may comprise a spring.

The spring may be mounted such that a first end of the spring is fixed on the second lever and a second end of the spring is fixed on the first lever.

The spring may be mounted such that a first end of the spring is fixed on the back support and a second end of the spring is fixed on the base support.

The tilt mechanism may comprise a furniture substructure, e.g. a chair base support. The first lever may be pivotably mounted to the chair base support at the first pivot axis. The backrest support may be pivotably mounted to the chair base support at a third pivot axis which is offset from the second pivot axis.

When the tilt mechanism comprises the third lever, the third lever may be coupled to the base support. The third lever may be pivotable relative to the base support.

The third lever may be engaged with a slot of the backrest support. A pin may project into the slot of the backrest support. As the backrest support is reclined, the slot of the backrest support may travel along the pin. The slot of the backrest support in combination with the pin may limit travel of the seat. The pin may be mounted to be stationary relative to the base support. The pin may be fixed to the base support.

The tilt mechanism may further comprise a carrier. The first lever may be pivotably mounted to the carrier at the first pivot axis. The backrest support may be pivotably mounted to the carrier at a third pivot axis which is offset from the second pivot axis.

When the tilt mechanism comprises the third lever, the third lever may be pivotably mounted to the carrier at the third pivot axis.

The carrier may have a U-shaped portion. At least a portion of the first lever and at least a portion of the second lever may extend in a cavity defined by the U-shaped portion. The portion of the second lever may remain positioned in the cavity defined by the U-shaped portion while the backrest support is pivoted from a frontmost position to a rearmost position.

The first lever may have a recess into which part of the second lever extends.

The tilt mechanism may comprise a seat attached to the mount structure of the first lever. The seat may have a pocket at its lateral side in which the tilt mechanism is accommodated. Two tilt mechanisms may be installed at the two opposite lateral sides of the seat. Two tilt mechanisms which have mirror-symmetric configurations may be installed on the two lateral sides of the seat. The two tilt mechanisms may be installed such that a central portion below the seat remains clear of components of the tilt mechanism. The two tilt mechanisms may be installed in a chair which does not have a central support for the seat, in particular in a chair which does not have a central column.

The mount structure of the first lever and/or the mount structure of the third lever may respectively comprise an opening. An attachment member, such as a bolt, may extend through the opening to attach the seat to the mount structure.

The tilt mechanism may comprise a backrest attached to the backrest support. The backrest may be attached to the backrest support in a fixed manner, e.g., using bolts, screws, or other techniques.

The tilt mechanism may be configured such that it is installable both in a seat which has a central support and in seat which does not have a central support. The tilt mechanism may be connected to a seat made from a flexible membrane, e.g. a mesh seat. The tilt mechanism may provide weight-responsive tension in a chair which does not have a rigid support extending at a lower side of the seat.

The tilt mechanism may be formed as a device which can be attached to the seat as a modular unit.

According to an embodiment, a seating furniture, e.g. a chair, is provided. The seating furniture has a seat, a backrest, and a first tilt mechanism and a second tilt mechanism. Each one of the first and second tilt mechanisms respectively comprises a backrest support, a first lever, and a second lever. The backrest support is respectively attached to the backrest and is pivotably mounted. The first lever is respectively attached to the seat and is mounted to be pivotable about a first pivot axis. The second lever is pivotably attached to the backrest support at a second pivot axis and is coupled to the first lever by a coupling mechanism to pivot the first lever about the first pivot axis when the backrest support pivots relative to the carrier.

Each one of the first and second tilt mechanisms may respectively comprise a third lever attached to the seat. The third lever may be provided such that it is disposed rearward of the first lever.

Each one of the first and second tilt mechanisms may respectively comprise an energy storage mechanism. The energy storage mechanism may be connected to the first lever and the second lever. The energy storage mechanism may be connected to the backrest support and a seat base structure.

Each one of the first and second tilt mechanisms may respectively be configured as a tilt mechanism according to an embodiment.

The first tilt mechanism and the second tilt mechanism may be constructed from the same set of components. I.e., tilt mechanisms of identical build or having the same basic constituents may be used on the two lateral sides of the seat.

The first lever of the first tilt mechanism may be attached to the seat at a first location and the third lever of the first tilt mechanism may be attached to the seat at a second location disposed rearward of the first location. The first lever of the second tilt mechanism may be attached to the seat at a first location and the third lever of the second tilt mechanism may be attached to the seat at a second location disposed rearward of the first location.

The first tilt mechanism and the second tilt mechanism may be arranged on opposite lateral sides of the seating furniture or of a modular unit of the seating furniture. The first tilt mechanism and the second tilt mechanism may be arranged on opposite lateral sides of the chair such that a central portion below the seat is left clear of components of the first and second tilt mechanisms.

The first tilt mechanism may be provided in a first pocket formed on a first lateral side of the seating furniture. The first pocket may be formed from a flexible material, e.g. from a flexible membrane. The second tilt mechanism may be provided in a second pocket formed on a second lateral side of the seating furniture. The second pocket may be formed from a flexible material, e.g. from a flexible membrane.

The first tilt mechanism and the second tilt mechanism may allow the seat to be folded up.

Various effects may be attained by the tilt mechanisms and seating furniture of embodiments. The tilt mechanism may be used on either side of a chair or other seating furniture and does not require the seating furniture to have a central support. If the seating furniture has a central support, e.g. a gas column, the tilt mechanism does not need to be coupled to the central support. The tilt mechanism may have small dimensions, in particular in a lateral direction of the chair, which allows part or all of the tilt mechanism to be hidden from view. In the tilt mechanism, the second lever causes the first lever to pivot when the backrest is reclined, thereby applying a torque onto the backrest which varies as a function of the weight of the person sitting on the seat. The first lever and, if present, third lever may move the seat in an upward and forward direction when the backrest is reclined, which is desired for ergonomic reasons. Two tilt mechanisms may be used on opposite lateral sides of the chair, leaving a central portion under the seat clear of components which apply a weight-responsive torque onto the backrest. Such a configuration renders the tilt mechanism particularly suitable for chairs having a mesh seat or otherwise seats with flexible membranes because the tilt mechanisms are positioned on the two sides of the seat. This provides room for elastic deformation of the seat when the user is sitting. The position of the tilt mechanisms at the lateral side of the seat for providing weight-responsive recline characteristics provides enhanced versatility and advantages in the design of the chair.

The tilt mechanism and seating furniture according to embodiments may be utilized for various applications in which it is desired that the backrest applies a force during recline which depends on the weight of the person sitting on the seat. For illustration, the tilt mechanism may be installed in office chairs, community seating, chairs for the hospital sector, seats for the house, domestic furniture, seating on airports and in general waiting rooms, other public seating, seating for collaborative areas, without being limited thereto.

BRIEF DESCRIPTION OF DRAWINGS

Embodiments of the invention will be described with reference to the accompanying drawings in which like reference numerals designate like elements.

DETAILED DESCRIPTION OF EMBODIMENTS

Exemplary embodiments of the invention will be described with reference to the drawings. While some embodiments will be described in the context of specific fields of application, such as in the context of an office-type chair or a chair having four legs, the embodiments are not limited to this field of application. The features of the various embodiments may be combined with each other unless specifically stated otherwise.

It should be understood that the terms "forward", "rearward", "lateral", "left" and "right" as used herein, each have a particular meaning that is defined in relation to a flat support surface beneath the chair and in relation to an occupant of the chair. For instance, the term "forward" refers to a direction moving away from the chair backrest and in front of a chair occupant along an axis which extends parallel to such a flat support surface, while the term "rearward" refers to a direction opposite of the forward direction. The term "lateral" refers to a generally horizontal direction perpendicular to both the forward and rearward direction and extending parallel to the aforementioned flat support surface.

According to embodiments, a tilt mechanism is provided which comprises a plurality of levers which may be combined in a compact assembly. Generally, the tilt mechanism is operative to exert a force onto a backrest of a chair when the backrest is reclined, the torque depending on a weight of a person sitting on a seat of the chair. Thereby, weight-responsive behaviour is provided. The tilt mechanism may be mounted to the chair at a lateral side of the seat. Two tilt mechanisms of embodiments may be installed on opposite lateral sides of the seat. The tilt mechanisms may be installed such that they extend laterally adjacent to at least part of the seat. A part of the seat may be interposed between the two tilt mechanisms.

The tilt mechanism of embodiments may comprise a base support of the seating furniture, e.g. a chair base support, or a carrier which, in use, may be fixedly attached to a base assembly of the seating furniture. The tilt mechanism further comprises a first lever which is pivotably coupled to the chair base support or to the carrier and, in use of the tilt mechanism, is attached to the seat. The first lever may act as a support for the seat, in particular for a front portion of the seat. The tilt mechanism comprises a backrest support which is pivotably coupled to the base assembly or to the carrier. The tilt mechanism comprises a second lever which may be pivotably coupled to both the backrest support and the first lever. The second lever causes the first lever to pivot relative to the chair base support or to the carrier when the backrest support is pivoted, thereby lifting the seat with the person sitting thereon when the backrest is reclined backward and lowering the seat with the person sitting thereon when the backrest is moved forward.

Figure 1:
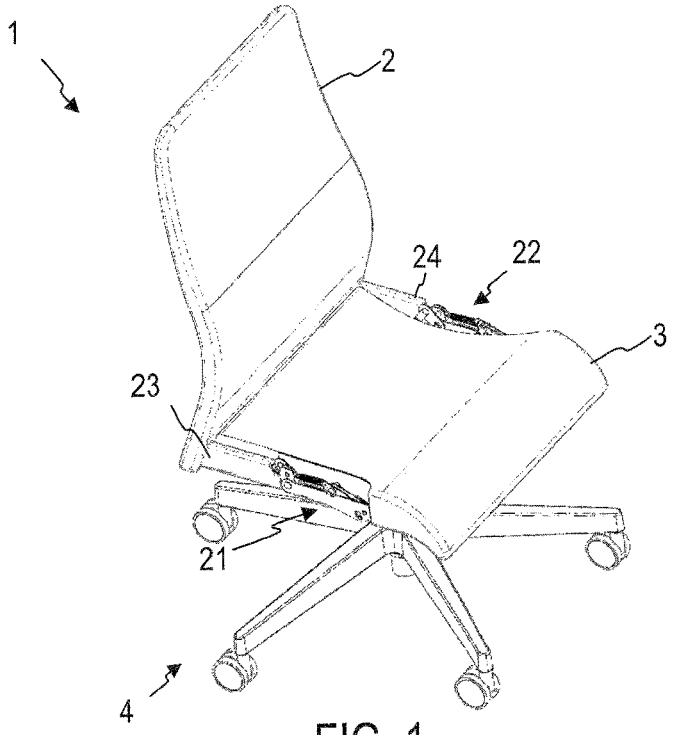
FIG. 1 is a perspective view of a chair having a tilt mechanism according to an embodiment.
Figure 2:
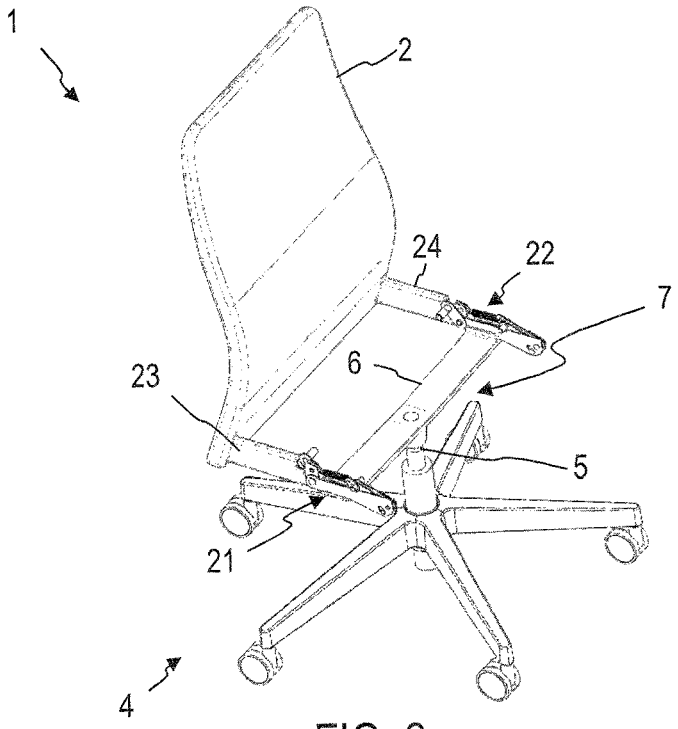
FIG. 2 is a perspective view of the chair of FIG. 1 with the seat removed.
Figure 3:
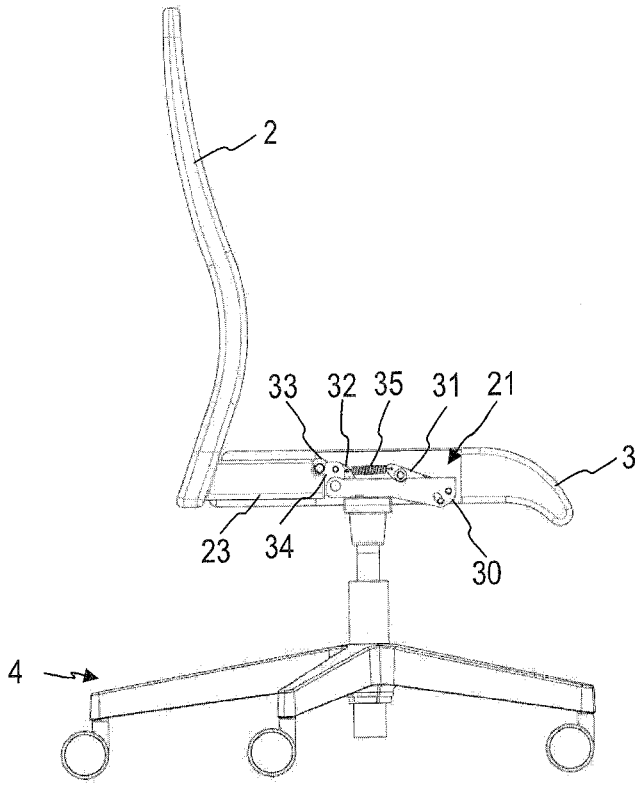
FIG. 3 is a side view of the chair of FIG. 1.

FIG. 1 to FIG. 3 show a chair 1 according to an embodiment. The chair 1 has a backrest 2, a seat 3, and a base assembly 4. The base assembly 4 supports the chair 1 on a floor. The chair 1 may be an office-type chair in which the base assembly 4 has a central column 5 on which the superstructure of the chair 1 rests.

The chair 1 has a first tilt mechanism 21 and a second tilt mechanism 22 according to an embodiment. The first tilt mechanism 21 and a second tilt mechanism 22 are positioned at lateral sides of the seat 3. The first tilt mechanism 21 and second tilt mechanism 22 may be laterally offset from a central region 7 below the seat 3. While structural components of the superstructure, such as a cross member 6, may extend across the central region 7, the first tilt mechanism 21 and a second tilt mechanism 22 are laterally offset from the central region 7.

Referring to FIG. 3, the tilt mechanism 21 of an embodiment has a carrier 30. The carrier 30 may be fixedly attached to the base assembly 4. The tilt mechanism 21 has a first lever 31 and a third lever 33, which respectively are attached to the seat 3. The first lever 31 and the third lever 33 may be pivotably attached to the seat 3. The tilt mechanism 21 has a backrest support 34. In the installed state of the tilt mechanism 21, the backrest support 34 may be fixedly attached to the backrest 2. For illustration, the backrest support 34 may be attached to a lateral arm 23 of the backrest 2.

As will be described in more detail with reference to FIG. 5 to FIG. 10, the tilt mechanism 21 of an embodiment further has a second lever 32 which is pivotably attached to the first lever 31 and the backrest support 34. The second lever 32 is operative to force the first lever 31 to pivot relative to the carrier 30 when the backrest support 34 pivots relative to the carrier 30. The movement of the seat 3 induced by the movement of the first lever 31 also causes the third lever 33 to pivot relative to the carrier 30. An energy storage mechanism, which may comprise a spring 35, is connected between the second lever 32 and the first lever 31 to provide a self-balancing function.

The second tilt mechanism 22 installed on the opposite lateral side of the chair 1 may have the same components and operation as the first tilt mechanism 21. The second tilt mechanism 22 may be identical or mirror-symmetric to the first tilt mechanism 21.

The small width in the lateral dimension allows the first tilt mechanism 21 and/or second tilt mechanism 22 to be partially hidden from view. For illustration, at least part of the first tilt mechanism 21 may be arranged in a first lateral pocket (not shown in FIG. 1 to FIG. 3) of the seat 3, and at least part of the second tilt mechanism 22 may be arranged in a second lateral pocket (not shown in FIG. 1 to FIG. 3) on the opposite lateral side of the seat 3.

With the first and second tilt mechanisms 21, 22 being installed at lateral sides of the seat, the tilt mechanisms may also be installed in chairs which do not have a central support.

Figure 4:
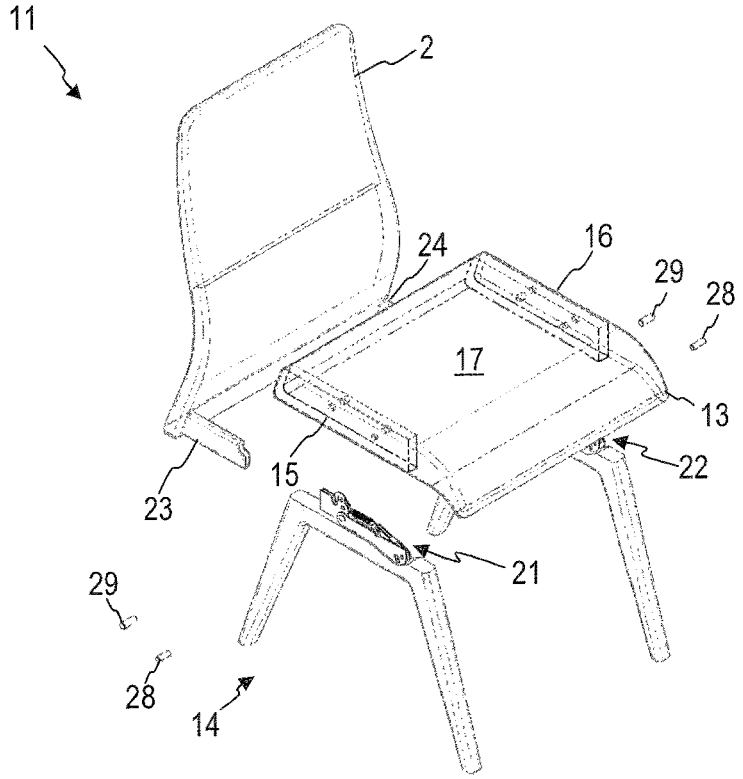
FIG. 4 is a perspective exploded view of another chair having a tilt mechanism according to an embodiment, the chair having no central support below the seat.

FIG. 4 is an exploded perspective view of a chair 11 according to another embodiment. The chair 11 has a backrest 2, a seat 13, and a base assembly 14. The base assembly 14 supports the chair 11 on a floor. The base assembly 14 does not have a central support. In the chair 11 shown in FIG. 4, the base assembly 14 has four legs which support the chair superstructure. A pair of tilt mechanisms 21, 22 according to an embodiment is installed at lateral sides of the seat 13. The space below a central portion 14 of the seat 13 may remain clear of components of the tilt mechanisms 21, 22.

The chair 11 has a first tilt mechanism 21 and a second tilt mechanism 22 of an embodiment. At least part of the first tilt mechanism 21 may be received in a first pocket 15 on a lateral side of the seat 13 to thereby hide at least part of the first tilt mechanism 21 from view. At least part of the second tilt mechanism 22 may be received in a second pocket 16 on the opposite lateral side of the seat 13 to thereby hide at least part of the second tilt mechanism 22 from view. The first lever 31 of the first tilt mechanism 21 may be pivotably attached to the seat 13 using a pin 28. The pin 28 may be inserted through a mount hole of the first lever 31 and may project into a mating recess on the seat 13. The third lever 33 of the first tilt mechanism 21 may be pivotably attached to the seat 13 using another pin 29. The other pin 29 may be inserted through a mount hole of the third lever 33 and may project into a mating recess on the seat 13. The second tilt mechanism 22 may be similarly attached to the seat 13 at the second pocket 16.

The first tilt mechanism 21 and the second tilt mechanism 22 provide weight-responsive recline characteristics for the chair 11, but do not obstruct the space below the central portion 17 of the seat 13. The central portion 17 could even be formed from a flexible membrane, e.g. from a mesh or other deformable material, because the position of the first tilt mechanism 21 and of the second tilt mechanism 22 allows the central portion 17 do deform downwardly when a person sits thereon.

With reference to FIG. 5 to FIG. 10, a tilt mechanism 21 of an embodiment will be described in more detail. Tilt mechanisms according to further embodiments will be explained with reference to FIG. 11 to FIG. 17.

As explained with reference to FIG. 1 to FIG. 4, two tilt mechanisms having a configuration as described with reference to FIG. 5 to FIG. 17 may be installed at the two opposite lateral sides of the seat.

Figure 5:
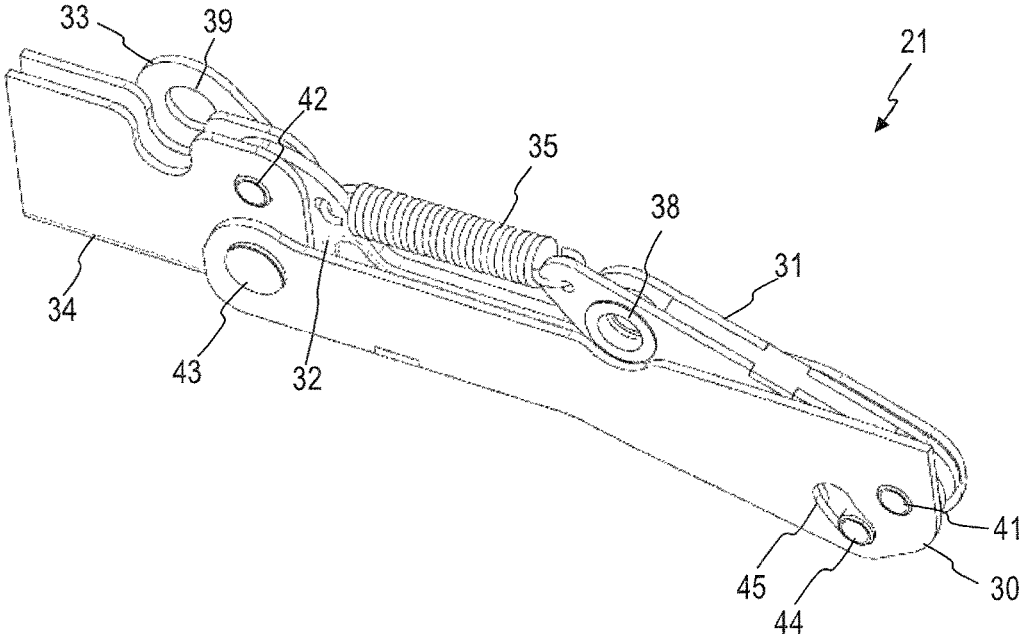
FIG. 5 is a perspective view of a tilt mechanism according to an embodiment.
Figure 6:
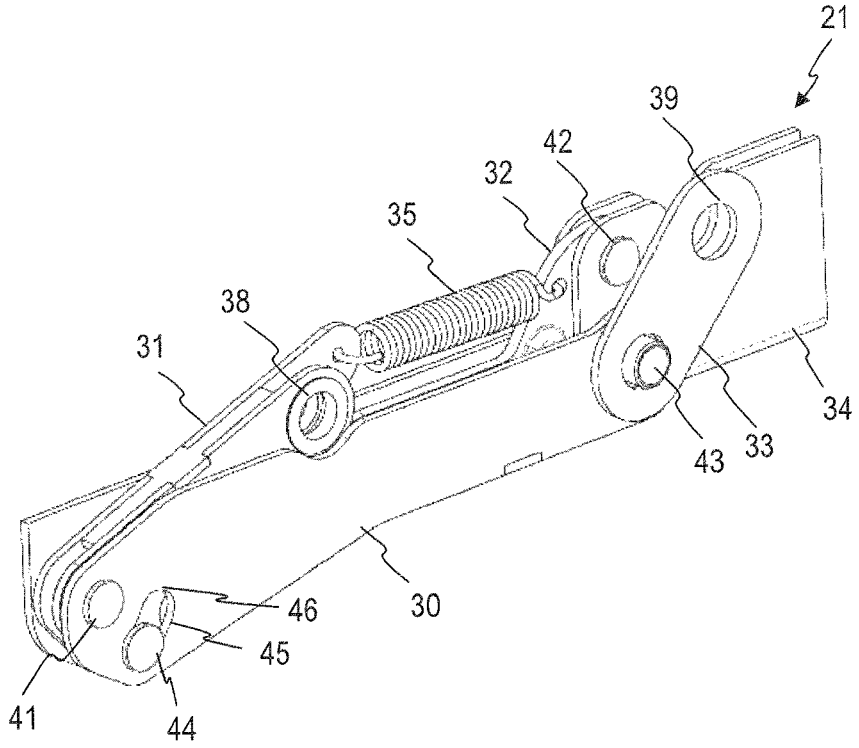
FIG. 6 is a perspective view of the tilt mechanism of FIG. 5 when the backrest is in a forward rest position.
Figure 7:
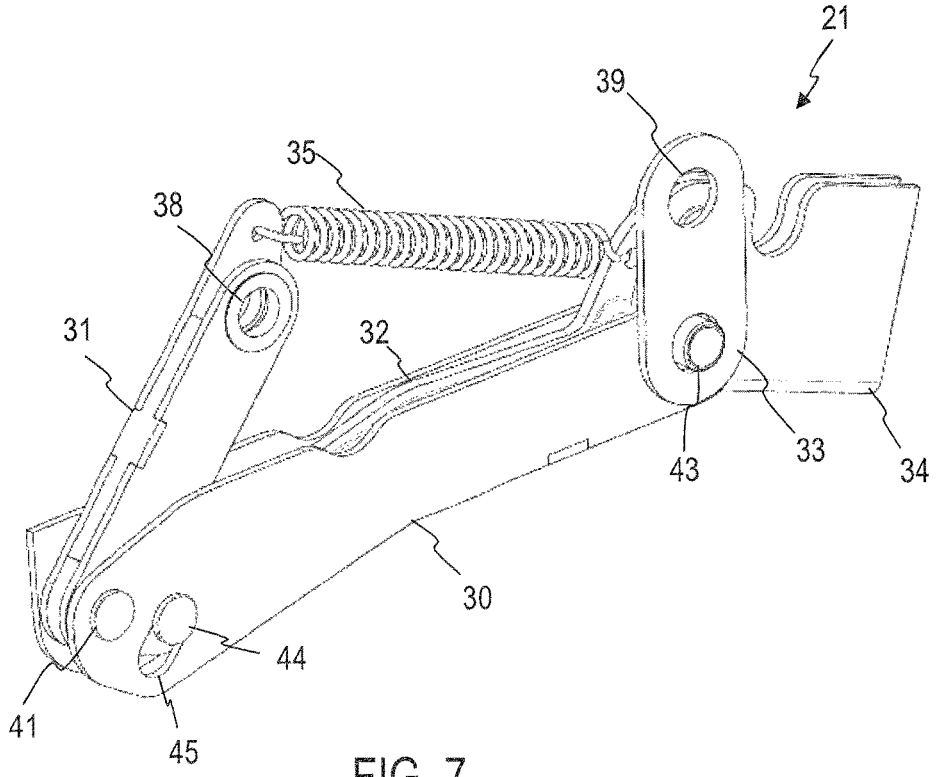
FIG. 7 is a perspective view of the tilt mechanism of FIG. 5 when the backrest is reclined.
Figure 8:
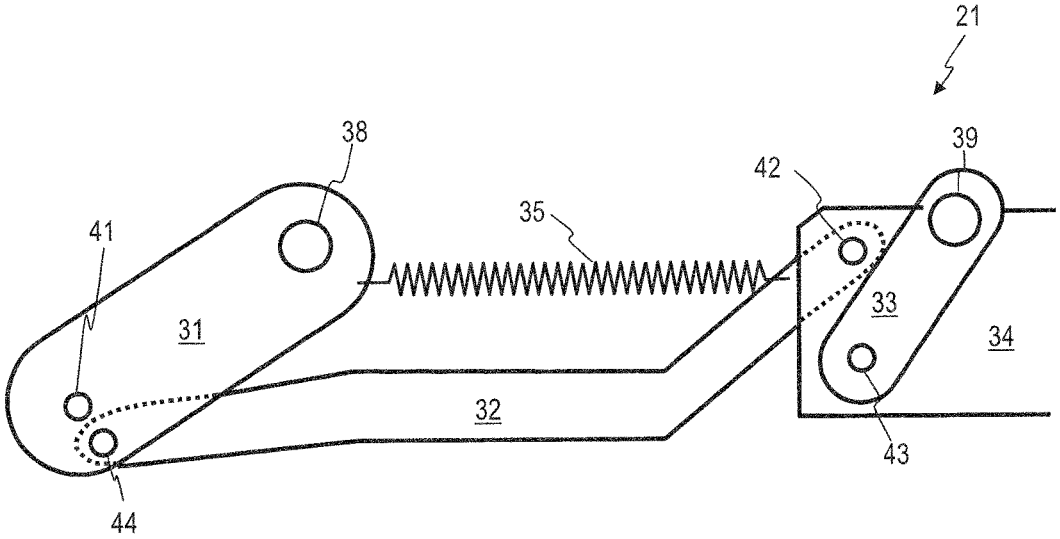
FIG. 8 is a partial side view of the tilt mechanism of FIG. 5 when the backrest is in a forward rest position.
Figure 9:
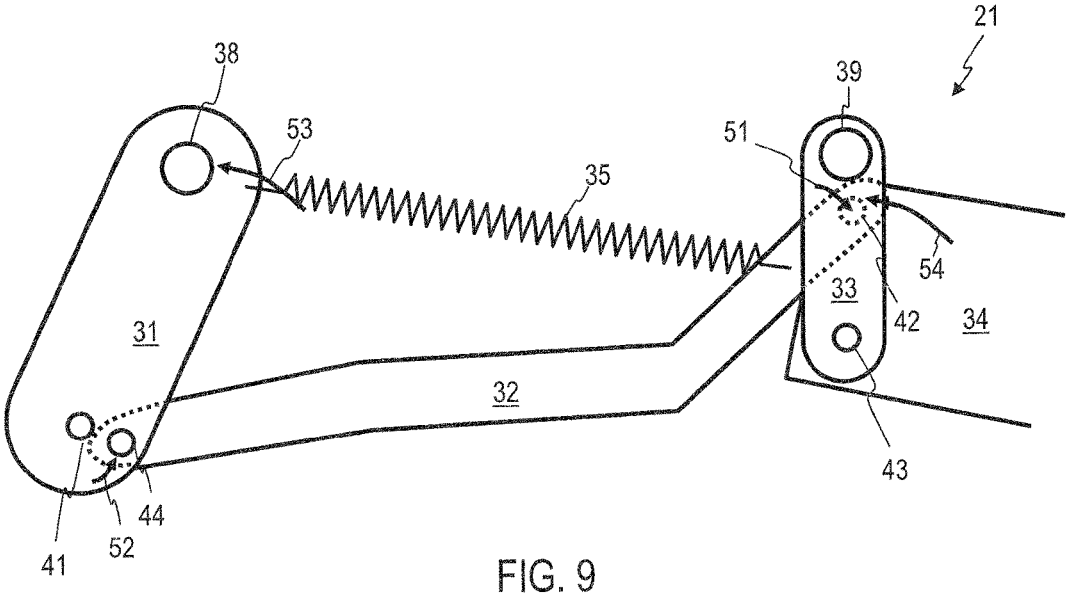
FIG. 9 is a partial side view of the tilt mechanism of FIG. 5 when the backrest is reclined.
Figure 10:
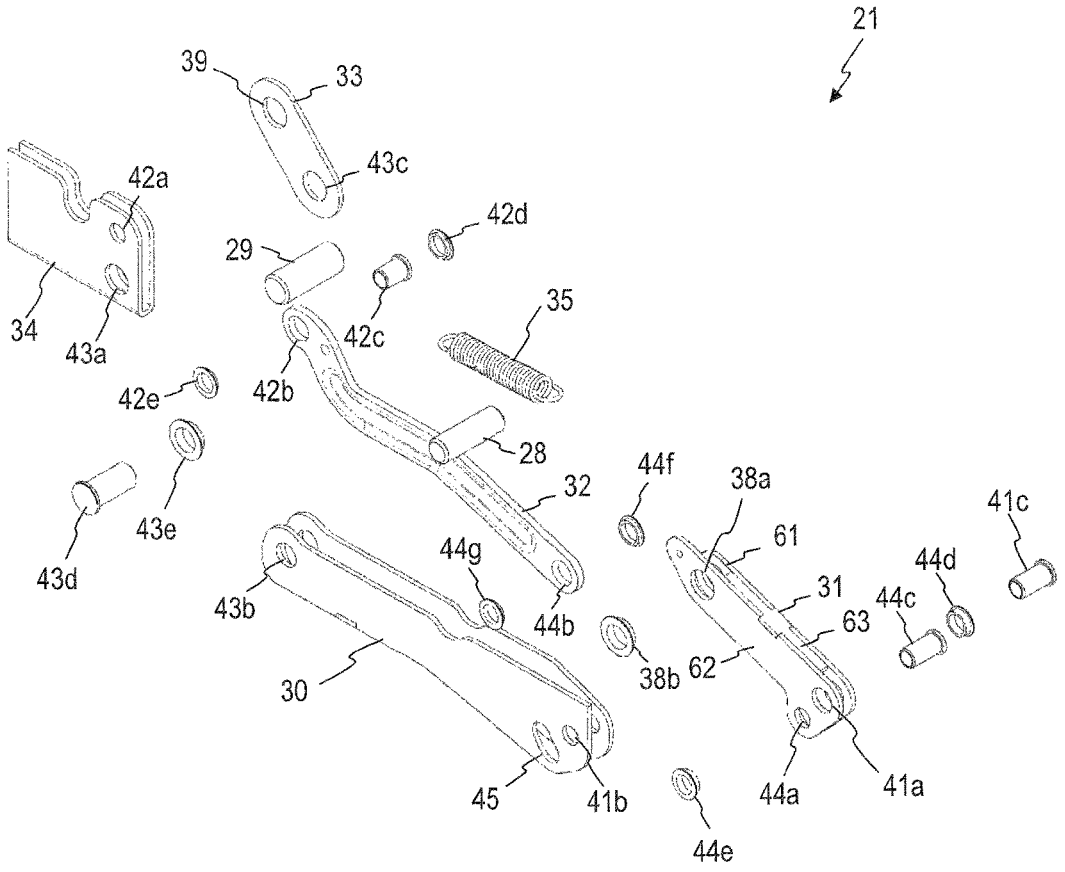
FIG. 10 is an exploded perspective view of a tilt mechanism according to an embodiment.

FIG. 5 shows a perspective view of the tilt mechanism 21 of an embodiment. FIG. 6 shows a perspective view and FIG. 8 shows a partial side view of the tilt mechanism 21 when the backrest is in the forward rest position. FIG. 7 shows a perspective view and FIG. 9 shows a partial side view of the tilt mechanism 21 when the backrest is reclined. In the side views of FIG. 8 and FIG. 9, the carrier 30 is omitted for clarity. Hidden parts of the second lever are shown in broken lines. FIG. 10 is a perspective exploded view of a tilt mechanism 21 according to an embodiment.

The tilt mechanism 21 may comprise a carrier 30. When the tilt mechanism 21 is installed, the carrier 30 may be the fixed part of the tilt mechanism 21. The carrier 30 may be attached to a chair such that the carrier 30 remains stationary relative to a base assembly of the chair. The carrier 30 may have a U-shape configuration, with at least part of the first lever 31 and the second lever 32 being disposed within a cavity defined by the U-shape of the carrier 30. The U-shaped carrier 30 may comprise a first wall section and a second wall section parallel to the first wall section, with the first lever 31 and the second lever 32 entering a space between the first wall section and the second wall section of the carrier 30.

The tilt mechanism 21 comprises the backrest support 34. The backrest support 34 is pivotably connected to the carrier 30. A corresponding pivot axis for the backrest support 34 may be formed by a pin which extends through the backrest support 34. Thanks to this hinge connection the backrest support 34 can rotate around the carrier 30. When the tilt mechanism 21 is installed in a chair, the backrest of the chair is connected with the backrest support 34.

The tilt mechanism 21 comprises the first lever 31 configured to be attached to the seat of the chair. A first pivot axis 41 is positioned on a front part of the carrier 30. The first lever 31 is pivotably attached to the carrier 30 at the first pivot axis 41. The first lever 31 may pivot relative to the carrier about the first pivot axis 41. The first pivot axis 41 may have a fixed location relative to the carrier 30. The first pivot axis 41 may comprise a pin which extends through an opening in the carrier 30 and an opening in the first lever 31. The first lever 31 has a mount structure 38 for mounting the first lever 31 to the seat. The mount structure 38 may comprise a hole through which a pin 28 may be inserted to pivotably couple the first lever 31 to the seat. The first lever 31 may comprise a pair of walls, with the second lever 32 entering a space defined between the pair of walls of the first lever 31. The first lever 31 may be arranged on the carrier 30 such that the mount structure 38 is positioned rearward and upwardly of the first pivot axis 41 when the backrest is in the frontmost position. The tilt mechanism 21 may be configured such that the mount structure 38 remains positioned rearward and upwardly of the first pivot axis 41 while the backrest is reclined from its frontmost position to its rearmost position.

The tilt mechanism 21 comprises the second lever 32 which is pivotably attached to the backrest support 34 at a second pivot axis 42. The second pivot axis 42 may comprise a pin which projects through an opening in the backrest support 34 and an opening in the second lever 32. The second lever 32 is coupled to the first lever 31 by a coupling mechanism to pivot the first lever 31 about the first pivot axis 41 when the backrest support 34 pivots relative to the carrier 30. The second lever 32 may be pivotably coupled to the first lever 31 at a fourth pivot axis 44. The fourth pivot axis 44 may comprise a pin which extends through an opening in the first lever 31 and through an opening in the second lever 32. The fourth pivot axis 44 and the second pivot axis 42 may be attached to the second lever 32 at opposite ends of the second lever 32.

The pivot axis 44 may be provided at a fixed location on the first lever 31 and on the second lever 32. The pivot axis 44 may project into a recess 45 on the carrier 30. The recess 45 may be a guide slot. The guide slot may be curved about the first pivot axis 41. The recess 45 defines a travel of the first lever 31 and, thus, of the seat attached to the first lever 31.

An energy storage mechanism is connected to the first lever 31 and the second lever 32. The energy storage mechanism may be or may comprise a spring 35. The energy storage mechanism may be connected to the first lever 31 adjacent to the mount structure 38. The energy storage mechanism may be connected to the second lever 32 towards a rear end of the second lever 32, e.g. adjacent to the second pivot axis 42.

The tilt mechanism 21 may comprise a third lever 33. The third lever 33 may also be configured to be attached to the seat. The third lever 33 may have a mount structure 39 for mounting the third lever 33 to the seat. The mount structure 39 may comprise a hole through which a pin 39 may be inserted to pivotably couple the third lever 33 to the seat. The third lever 33 may be arranged on the carrier 30 such that the mount structure 39 is positioned rearward and upwardly of the third pivot axis 43 when the backrest is in the frontmost position. The third pivot axis 43 may also be the pivot axis at which the backrest support 34 is pivotably attached on the carrier 30. Thus, both the third lever 33 and the backrest support 34 may pivot relative to the carrier 30 about the third pivot axis 43.

The tilt mechanism 21 may be configured such that the backrest support 34 and the third lever 33 are caused to pivot in opposite directions about the third pivot axis 43. When the backrest support 34 is pivoted rearward during a recline motion of the backrest, the tilt mechanism 21 may cause the third lever 33 to simultaneously pivot in a forward direction, thereby causing the seat to lift and to move forward. When the backrest support 34 is pivoted forwardly, the tilt mechanism 21 may cause the third lever 33 to simultaneously pivot in a rearward direction, thereby causing the seat to be lowered and to move backward.

The operation of the tilt mechanism 21 will be described with particular reference to FIG. 8 and FIG. 9.

When the person sitting on the seat reclines the backrest of the chair, the backrest support 34 rotates about the third pivot axis 43. This causes a movement 51 of the second pivot axis 42 about the third pivot axis 43. The second lever 32 is thereby actuated and transmits a rotational movement to the first lever 31. Movement 51 of the second pivot axis 42 causes the fourth pivot axis 44 at the front portion of the second lever 32 to pivot about the first pivot axis 41. This movement 52 of the fourth pivot axis 44 also leads to a rotation of the first lever 31 about the first pivot axis 41. The mount structure 38 of the first lever 31 performs a movement 53 in the forward and upward direction. Accordingly, the part of the seat attached to the first lever 31 also performs a forward and upward movement as the backrest is reclined. This movement of the seat causes the third lever 33 to pivot about the third pivot axis 43 in a forward direction. The mount structure 39 of the third lever 33 is caused to perform a movement 54 in the forward and upward direction.

The reclining movement of the backrest causes the seat to be raised. The second lever 32 exerts a force onto the backrest support at the second pivot axis 42, with the magnitude of the force depending on the weight of the person sitting on the chair. Accordingly, the torque applied onto the backrest support 34 via the second lever 32 relative to the third pivot axis 43 depends on the weight of the person sitting on the seat.

When the backrest is moved in a forward direction, movements similar to the ones described with reference to FIG. 8 and FIG. 9 result, with the direction of the movement being respectively reversed.

As illustrated in FIG. 6 and FIG. 7, the spring 35 may be extended as the backrest is reclined. The spring 35 may be operative to bias the tilt mechanism 21 towards a rest configuration in which the backrest is in its frontmost position. The spring 35 may provide self-balancing of the tilt mechanism.

As best seen in FIG. 7, the travel of the first lever 31 is delimited by the guide recess 45 which is formed as a slot. For illustration, the first lever 31 cannot continue upward rotation when the fourth pivot axis 44 abuts on an end stop 46 of the recess 45. The operation of the tilt mechanism 21 can easily be adapted to a travel of the first lever 31 which is desired for a particular chair, by selecting a carrier 30 having a corresponding length of the recess 45.

Additionally or alternatively, the characteristics of the movement of the seat may be adjusted by varying the position at which the mount structure 39 of the third lever 33 is attached to the seat. The inclination of the third lever 33 has an influence on the stroke of the seat and therefore takes effect on the entire kinematics of the chair. In a chair using the tilt mechanism 21 of an embodiment, it is sufficient to change the position of the seat hole correspondent to the hole of mount structure 39 of the third lever 33 to obtain a different behaviour of the chair. In practice, without having to modify the tilt mechanism 21, different set-ups may be implemented at no additional cost. This is in contrast to conventional mechanisms where the kinematics typically cannot be changed during the assembly of the chair because the fulcrums of the mechanism are fixed. Accordingly, in a method of an embodiment, a pair of tilt mechanisms according to an embodiment is attached to lateral sides of the seat, with the inclination of the third lever 33 and the corresponding mount hole position on the seat being selected based on a target kinematics of the chair.

The various pivotable connections between the lever(s), backrest support and carrier of the tilt mechanism may be implemented in various ways. One exemplary implementation is illustrated in the exploded perspective view of FIG. 10.

FIG. 10 shows an exploded perspective view of a tilt mechanism 21 of an embodiment. The tilt mechanism 21 is operative as explained with reference to FIG. 5 to FIG. 9.

A first pivot mechanism which pivotably attaches the first lever 41 to the carrier 30 may comprise an opening 41*a* in the first lever 31 and an opening 41*b* in the carrier 30. A pin 41*c* may be inserted through the opening 41*a* in the first lever 31 and the opening 41*b* in the carrier 30.

A second pivot mechanism which pivotably attaches the second lever 32 to the backrest support 34 may comprise an opening 42*a* in the backrest support 34, an opening 42*b* in the second lever 32, and a pin 42*c* which extends through the opening 42*a* in the backrest support 34 and the opening 42*b* in the second lever 32. One or several fastening elements 42*d*, 42*e* may be attached to the pin 42*c* to secure the pin 42*c*.

A third pivot mechanism which pivotably attaches the third lever 33 and the backrest support 34 to the carrier 30 may comprise an opening 43*a* in the backrest support 34, an opening 43*b* in the carrier 30, an opening 43*c* in the third lever 33, and a pin 43*d* which extends through these openings. One or several fastening element(s) 43*e* may be attached to the pin 43*d* to secure the pin 43*d*.

A fourth pivot mechanism which pivotably attaches the second lever 32 to the first lever 31 may comprise an opening 44*a* in the first lever 31, an opening 44*b* in the second lever 32, and a pin 44*c* which extends through these opening. The pin 44*c* may further extend through the recess 45 in the carrier 30. One or several fastening element(s) 44*d*, 44*e* may be attached to the pin 44*c* to secure the pin 44*c*. The pin 44*c* may also pass through washers 44*f*, 44*g* which may be interposed between the second lever 32 and the walls of the first lever 31, for example.

The openings may respectively be circular. The pins may respectively have cylindrical outer shapes.

Other implementations of the various pivot connections may be used in other embodiments. For illustration, the pin which defines a pivot axis may respectively also be provided on one of the elements which are to be pivotably coupled and may extend through an opening on the other one of the elements which are pivotably coupled.

A configuration as explained with reference to FIG. 10 has the effect that a tilt mechanism may be easily adapted depending on whether it is to be installed on the left side or the right side of the seat. For illustration, the first lever 31 may comprise two walls 61, 62 and a connecting portion 63 which extends between the two walls 61, 62. If the two walls 61, 62 have different configurations, the two walls 61, 62 may be arranged in a manner which depends on whether tilt mechanism 21 is to be used on the left or the right side of the seat. The various other components required for implementing the various pivot mechanisms may be easily adapted to left-side or right-side configurations, without having to manufacture dedicated elements for left-side tilt mechanisms installed on the left side of the seat and right-side tilt mechanism installed on the right side of the seat.

Various modifications may be made to the tilt mechanism 21 explained in detail with reference to FIG. 5 to FIG. 10. For illustration, the tilt mechanism 21 does not need to have a dedicated carrier 30. The first lever 31, the backrest support 34, and the third lever 33 may be directly pivotably mounted to a seat base support. The seat base structure may be a seat base support of a chair which does not have a central column.

Tilt mechanisms and chairs according to further embodiments will be explained in more detail with reference to FIG. 11 to FIG. 17. While the tilt mechanisms illustrated in FIG. 11 to FIG. 17 may be directly attached to a base structure, the tilt mechanisms may include a carrier on which at least some of the levers are pivotably supported. The carrier may attach the tilt mechanism to the base structure, similarly to the operation of the carrier described with reference to FIG. 5 to FIG. 10 above.

Figure 11:
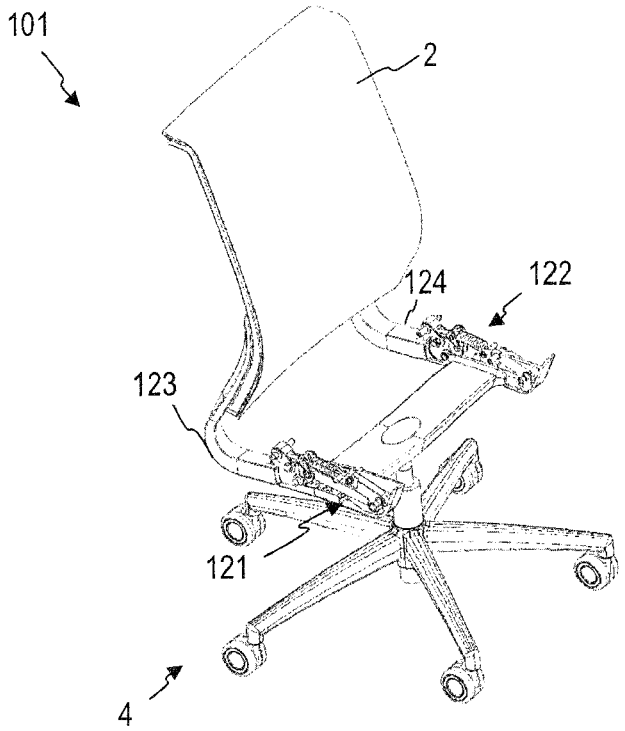
FIG. 11 is a perspective view of a chair including a tilt mechanism according to another embodiment with the seat removed.
Figure 12:
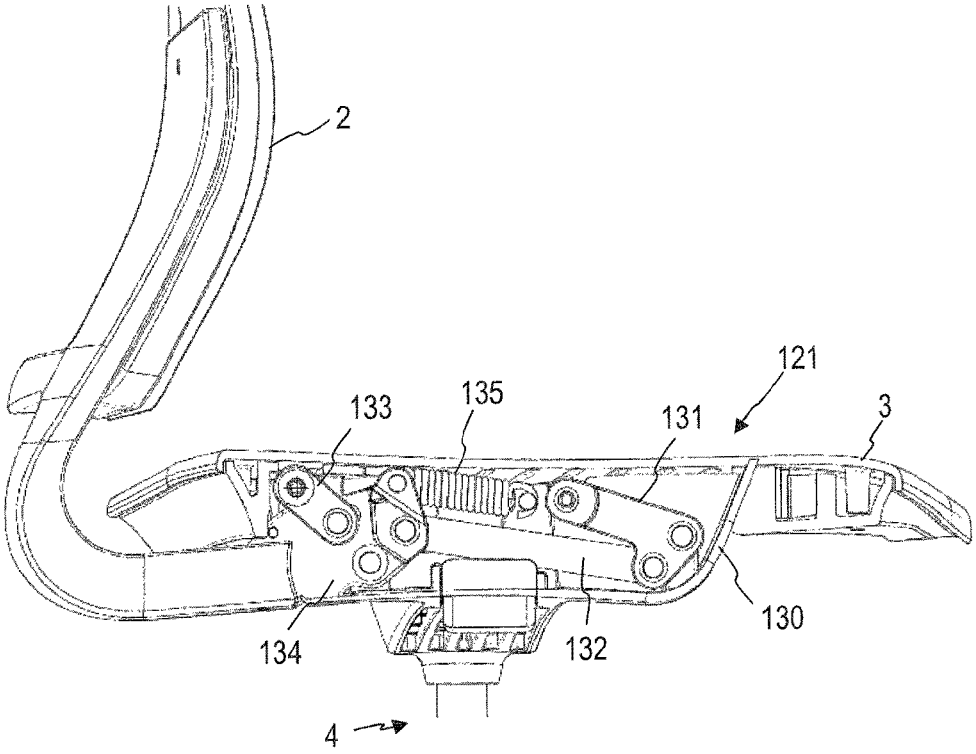
FIG. 12 is a partial side view of the chair having the tilt mechanism of FIG. 11 when the backrest is in a forward rest position.
Figure 13:
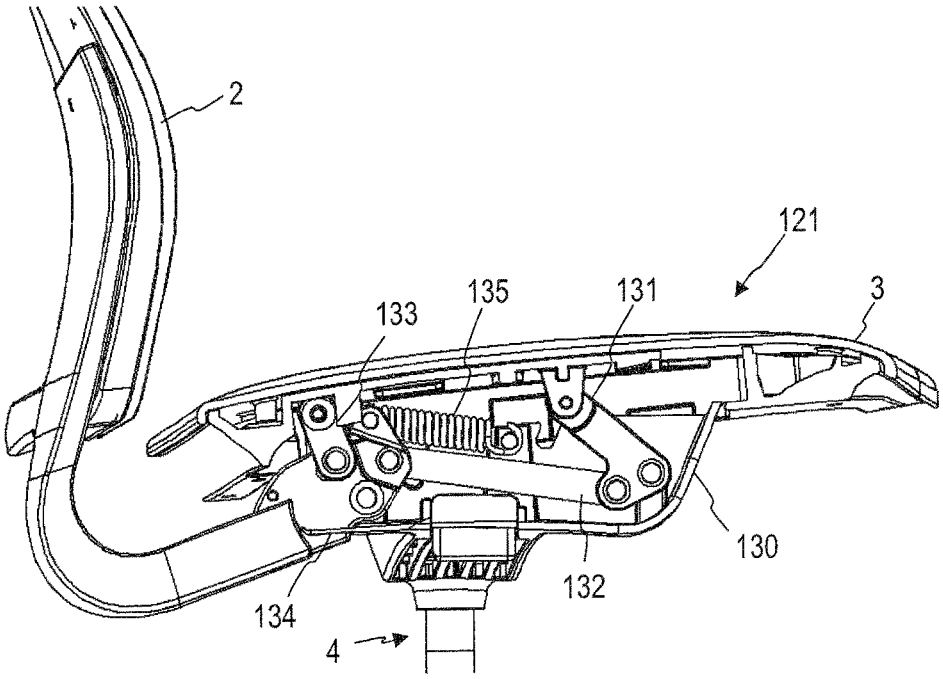
FIG. 13 is a partial side view of the chair having the tilt mechanism of FIG. 11 when the backrest is reclined.

FIG. 11 to FIG. 13 show a chair 101 according to another embodiment. FIG. 11 shows a perspective view with a seat removed. FIG. 12 shows a side view when the backrest is in the forward rest position. FIG. 13 shows a side view when the backrest is in a reclined position.

The chair 101 has a backrest 2, a seat 3, and a base assembly 4. The base assembly 4 supports the chair 101 on a floor. The chair 101 may be an office-type chair in which the base assembly 4 has a central column 5 on which the superstructure of the chair 101 rests.

The chair 101 has a first tilt mechanism 121 and a second tilt mechanism 122 according to an embodiment. The first tilt mechanism 121 and the second tilt mechanism 122 are positioned at lateral sides of the seat 3. The first tilt mechanism 121 and second tilt mechanism 122 may be laterally offset from a central region below the seat 3.

Referring to FIG. 12 and FIG. 13, various components of the tilt mechanism 121 are directly pivotably attached to a seat base support 130. The tilt mechanism 121 has a first lever 131 and a third lever 133, which respectively are attached to the seat 3. The first lever 131 and the third lever 133 may be pivotably attached to the seat 3.

The tilt mechanism 121 has a backrest support 134. In the installed state of the tilt mechanism 121, the backrest support 134 may be fixedly attached to the backrest 2. For illustration, the backrest support 134 may be attached to a lateral arm 123 of the backrest 2. As will be described in more detail with reference to FIG. 12 to FIG. 17, the tilt mechanism 121 of an embodiment further has a second lever 132 which is pivotably attached to the first lever 131 and the backrest support 134. The second lever 132 is operative to force the first lever 131 to pivot relative to the seat base support 130 when the backrest support 134 pivots relative to the seat base support 130. The movement of the seat 3 induced by the movement of the first lever 131 also causes the third lever 133 to be displaced relative to the seat base support 130. An energy storage mechanism, which may comprise a spring 135, may be connected between the backrest support 134 and the seat base support 130 to provide a self-balancing function.

The second tilt mechanism 122 installed on the opposite lateral side of the chair 101 may have the same components and operation as the first tilt mechanism 121. The second tilt mechanism 122 may be identical or mirror-symmetric to the first tilt mechanism 121. The backrest support of the second tilt mechanism 122 may be attached to another lateral arm 124 of the backrest 2.

While the first tilt mechanism 121 and second tilt mechanism 122 may be partially exposed at the lateral side of the seat as shown in FIG. 11 to FIG. 13, the small width in the lateral dimension also allows the first tilt mechanism 121 and/or second tilt mechanism 122 to be partially hidden from view. For illustration, at least part of the first tilt mechanism 121 may be arranged in a first lateral pocket (not shown in FIG. 11 to FIG. 13) of the seat 3, and at least part of the second tilt mechanism 122 may be arranged in a second lateral pocket (not shown in FIG. 11 to FIG. 13) on the opposite lateral side of the seat 3.

With the first and second tilt mechanisms 121, 122 being installed at lateral sides of the seat, the tilt mechanisms may also be installed in chairs which do not have a central support.

While the tilt mechanism 121 which will be described in more detail with reference to FIG. 14 to FIG. 17 below may be installed in a chair which has a central column, as illustrated in FIG. 11, the tilt mechanism 121 may also be used for chairs which do not have a central column. For illustration, the tilt mechanism 121 may be used for chairs configured as explained with reference to FIG. 4.

Figure 14:
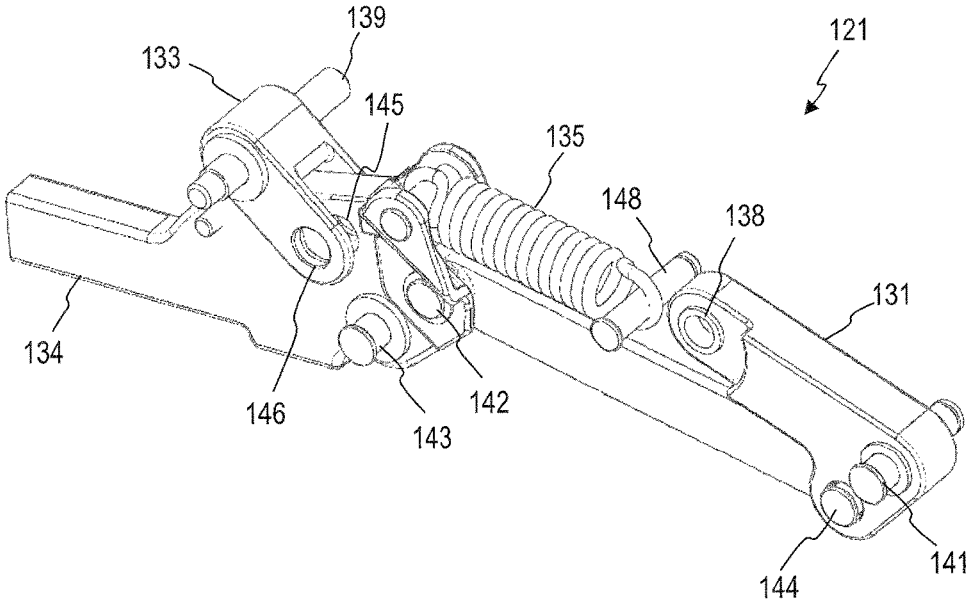
FIG. 14 is a perspective view of the tilt mechanism of the chair of FIG. 11 when the backrest is in a forward rest position.
Figure 15:
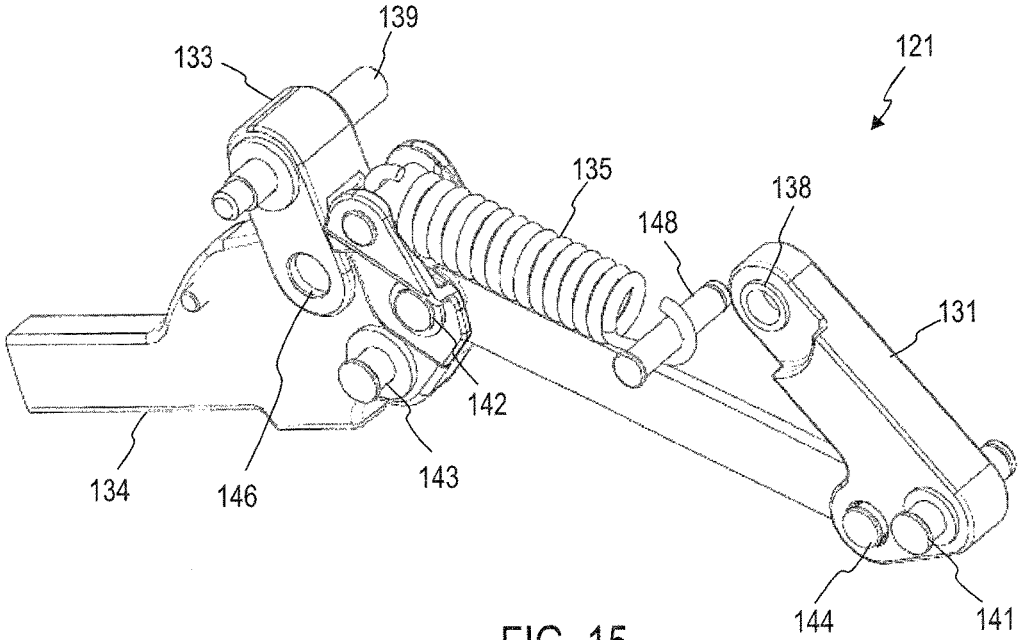
FIG. 15 is a perspective view of the tilt mechanism of the chair of FIG. 11 when the backrest is reclined.
Figure 16:
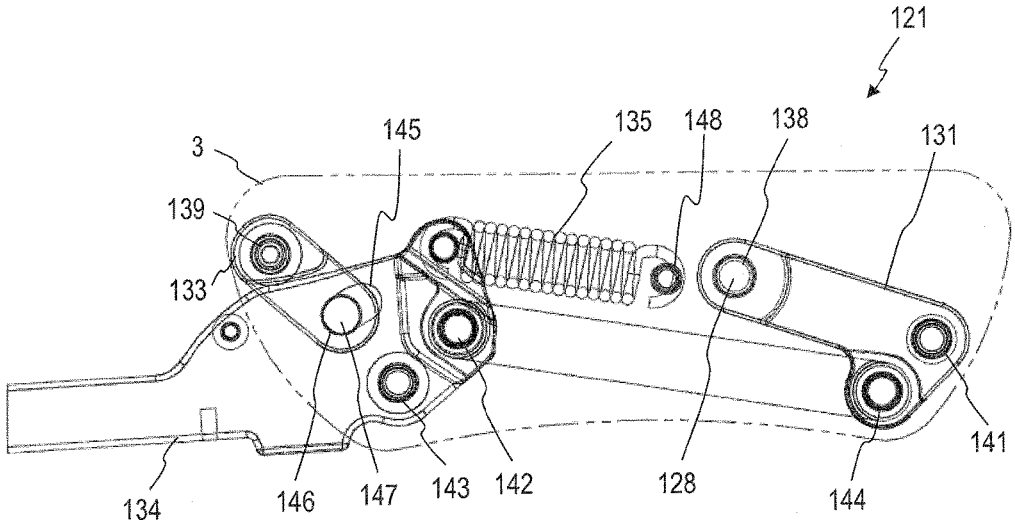
FIG. 16 is a side view of the tilt mechanism of the chair of FIG. 11 when the backrest is in a forward rest position.
Figure 17:
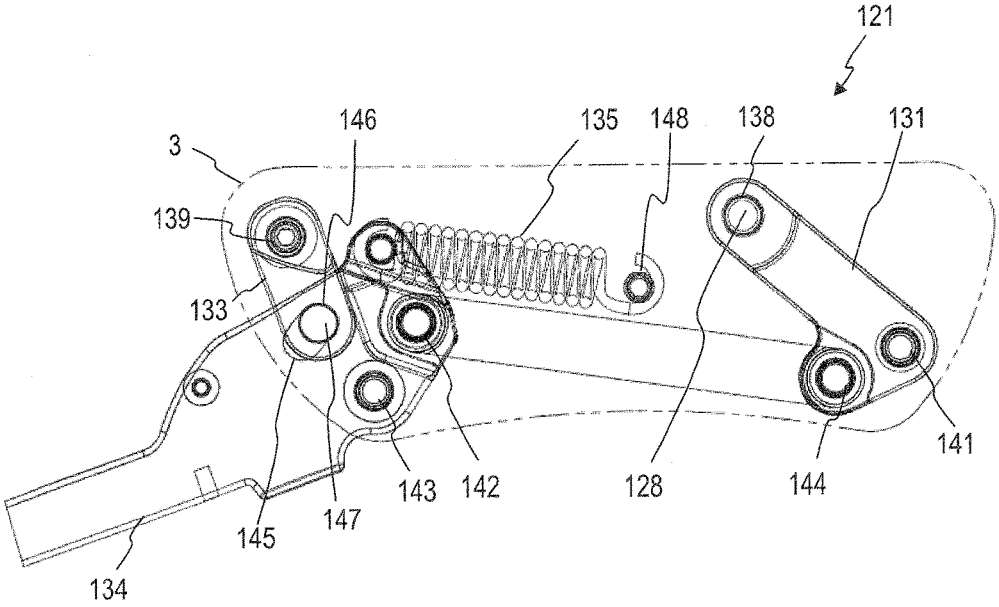
FIG. 17 is a side view of the tilt mechanism of the chair of FIG. 11 when the backrest is reclined.

FIG. 14 and FIG. 15 show a perspective view of the tilt mechanism 121 of an embodiment, with FIG. 14 representing the configuration when the backrest is in the forward rest position and FIG. 15 representing the configuration when the backrest is reclined. FIG. 16 and FIG. 17 show a side view of the tilt mechanism 121 of an embodiment, with FIG. 16 representing the configuration when the backrest is in the forward rest position and FIG. 17 representing the configuration when the backrest is reclined. In the views of FIG. 14 to FIG. 17, the seat base support 130 is omitted for clarity.

The tilt mechanism 121 may comprise or may be attached to a seat base support 130. When the tilt mechanism 121 is installed, the seat base support 130 may be the fixed part, with the first lever 131 and the backrest support 134 being pivotable relative to the seat base support 130. The seat base support 130 may be provided on a chair such that the seat base support 130 remains stationary relative to a base assembly of the chair.

The tilt mechanism 121 comprises the backrest support 134. The backrest support 134 is pivotably connected to the seat base support 130. A corresponding pivot axis for the backrest support 134 may be formed by a pin which extends through the backrest support 134 and forms a third pivot axis 143. By virtue of this hinge connection the backrest support 134 can rotate around the seat base support 130. When the tilt mechanism 121 is installed in a chair, the backrest of the chair is connected with the backrest support 134.

The tilt mechanism 121 comprises the first lever 131 configured to be attached to the seat of the chair. A first pivot axis 141 is positioned on a front part of the seat base support 130. The first lever 131 is pivotably attached to the seat base support 130 at the first pivot axis 141. The first lever 131 may pivot relative to the seat base support 130 about the first pivot axis 141. The first pivot axis 141 may have a fixed location relative to the seat base support 130. The first pivot axis 141 may comprise a pin which extends through an opening in the seat base support 130 and an opening in the first lever 131. The first lever 131 has a mount structure 138 for mounting the first lever 131 to the seat. The mount structure 138 may comprise a hole through which a pin may be inserted to pivotably couple the first lever 131 to the seat, as explained with reference to FIG. 5 to FIG. 10. The first lever 131 may comprise a pair of walls, with the second lever 132 entering a space defined between the pair of walls of the first lever 131. The first lever 131 may be arranged on the seat base support 130 such that the mount structure 138 is positioned rearward and upwardly of the first pivot axis 141 when the backrest is in the frontmost position. The tilt mechanism 121 may be configured such that the mount structure 138 remains positioned rearward and upwardly of the first pivot axis 141 while the backrest is reclined from its frontmost position to its rearmost position.

The tilt mechanism 121 comprises the second lever 132 which is pivotably attached to the backrest support 134 at a second pivot axis 142. The second pivot axis 142 may comprise a pin which projects through an opening in the backrest support 134 and an opening in the second lever 132. The second lever 132 is coupled to the first lever 131 by a coupling mechanism to pivot the first lever 131 about the first pivot axis 141 when the backrest support 134 pivots relative to the seat base support 130. The second lever 132 may be pivotably coupled to the first lever 131 at a fourth pivot axis 144. The fourth pivot axis 144 may comprise a pin which extends through an opening in the first lever 131 and through an opening in the second lever 132. The fourth pivot axis 144 and the second pivot axis 142 may be attached to the second lever 132 at opposite ends of the second lever 132.

The fourth pivot axis 144 may be provided at a fixed location on the first lever 131 and on the second lever 132.

An energy storage mechanism may be connected to the backrest support 134 and the seat base support 130. The energy storage mechanism may be or may comprise a spring 135. The energy storage mechanism may be connected to the backrest support 134 towards a forward end of the backrest support 134, e.g. adjacent to the second pivot axis 142. The energy storage mechanism may be connected to the backrest support 134 by a pin. The energy storage mechanism may be connected to the seat base support 130 by another mount 148, which may be a pin.

The tilt mechanism 121 may comprise a third lever 133. The third lever 133 may also be configured to be attached to the seat. The third lever 133 may have a mount structure 139 for mounting the third lever 133 to the seat. The mount structure 139 may comprise a hole in the third lever 133 through which a pin may be inserted to pivotably couple the third lever 133 to the seat. The third lever 133 may be coupled to the base support 130. A pin 147 may be received in a hole 146 of the third lever 133. In operation, the third lever 133 may pivot about the pin 147. The pin 147 may be attached to the base support 130 such that it is not displaced relative to the base support 130. The pin 147 may project into a slot 145 formed on the backrest support 133. When the backrest support 134 is reclined, the slot 145 may be displaced along the pin 147, thereby travelling along the pin 147. The pin 147 may remain stationary during a recline motion.

The slot 145 in cooperation with the pin 147 thereinto may limit travel of the seat 3. For illustration, as best seen in FIG. 17, a further reclining movement of the backrest 2 may be prevented when an end of the slot 145 abuts on the pin 147.

In the tilt mechanism of FIG. 11 to FIG. 17, the pin 147 may be fix relative to the base support 130. The slot 145 may be formed in the backrest support 134. When the user tilts the backrest of the chair, the abutment of the ends of the slot 145 on the stationary pin 147 may determine the front and rear stops. The third lever 133 does not need to engage the slot 145 or otherwise exert a force onto the slot 145. In other embodiments, and as explained with reference to FIG. 5 to FIG. 10 above, the travel may be limited in other ways, e.g. by engagement between the base support and the first lever.

The tilt mechanism 121 may be configured such that the backrest support 134 and the third lever 133 are caused to move in opposite directions when the backrest support 134 is reclined. When the backrest support 134 is pivoted rearward during a recline motion of the backrest, the tilt mechanism 121 may cause the third lever 133 to simultaneously move in a forward direction, thereby causing the seat to lift and to move forward. When the backrest support 134 is pivoted forwardly, the tilt mechanism 121 may cause the third lever 133 to simultaneously move in a rearward direction, thereby causing the seat to be lowered and to move backward.

The operation of the tilt mechanism 121 will be described with particular reference to FIG. 16 and FIG. 17.

When the person sitting on the seat reclines the backrest of the chair, the backrest support 134 rotates about the third pivot axis 143. This causes a movement of the second pivot axis 142 about the third pivot axis 143. The second lever 132 is thereby actuated and transmits a rotational movement to the first lever 131. A movement of the second pivot axis 142 causes the fourth pivot axis 144 at the front portion of the second lever 132 to pivot about the first pivot axis 141. This movement of the fourth pivot axis 144 leads to a rotation of the first lever 131 about the first pivot axis 141. The mount structure 138 of the first lever 131 performs a movement in the forward and upward direction. Accordingly, the part of the seat attached to the first lever 131 also performs a forward and upward movement as the backrest is reclined. This movement of the seat causes the third lever 133 to move in a forward direction. The mount structure 139 of the third lever 133 moves in the forward and upward direction. The pin 147 received in the hole 146 of the third lever 133 travels along the slot 145 until it abuts on an end of the slot 145, thereby limiting movement of the seat 3.

The reclining movement of the backrest causes the seat to be raised. The second lever 132 exerts a force onto the backrest support at the second pivot axis 142, with the magnitude of the force depending on the weight of the person sitting on the chair. Accordingly, the torque applied onto the backrest support 134 via the second lever 132 relative to the third pivot axis 143 depends on the weight of the person sitting on the seat.

When the backrest is moved in a forward direction, movements similar to the ones described with reference to FIG. 16 and FIG. 17 result, with the direction of the movement being respectively reversed.

As illustrated in FIG. 16 and FIG. 17, the spring 35 may be extended as the backrest is reclined. The spring 135 may be operative to bias the tilt mechanism 121 towards a rest configuration in which the backrest is in its frontmost position. The spring 135 may provide self-balancing of the tilt mechanism.

As best seen in FIG. 17, the travel of the backrest support 134 is delimited by the interplay between the ends of the slot 145 and the pin 147. For illustration, the backrest support 134 cannot continue a forward movement when an end stop of the slot 145 abuts on the pin 147. The operation of the tilt mechanism 121 can easily be adapted to a travel of the seat 3 which is desired for a particular chair, by selecting a backrest support 134 having a corresponding length of the slot 145.

Additionally or alternatively, the characteristics of the movement of the seat may be adjusted by varying the position at which the mount structure 139 of the third lever 133 is attached to the seat. The inclination of the third lever 133 has an influence on the stroke of the seat and therefore takes effect on the entire kinematics of the chair. In a chair using the tilt mechanism 121 of an embodiment, it is sufficient to change the position of the seat hole correspondent to the hole of mount structure 139 of the third lever 133 to obtain a different behaviour of the chair. In practice, without having to modify the tilt mechanism 121, different set-ups may be implemented at no additional cost. This is in contrast to conventional mechanisms where the kinematics typically cannot be changed during the assembly of the chair because the fulcrums of the mechanism are fixed. Accordingly, in a method of an embodiment, a pair of tilt mechanisms according to an embodiment is attached to lateral sides of the seat, with the inclination of the third lever 133 and the corresponding mount hole position on the seat being selected based on a target kinematics of the chair.

The tilt mechanisms according to embodiments may be used in a wide variety of chairs or other seating furniture. Seating furniture according to embodiments which include at least one tilt mechanism according to an embodiment will be described in more detail with reference to FIG. 18 to FIG. 26. It will be appreciated that the tilt mechanisms may be used in still other types and kinds of seating furniture.

The seating furniture described with reference to FIG. 18 to FIG. 26 includes a first tilt mechanism 191 and a second tilt mechanism 192. The tilt mechanisms 191, 192 may have the configuration of the tilt mechanisms 21, 22 explained in detail with reference to FIG. 5 to FIG. 10, for example. The tilt mechanisms 191, 192 may have the configuration of the tilt mechanisms 121, 122 explained in detail with reference to FIG. 11 to FIG. 17, for example.

Figure 18:
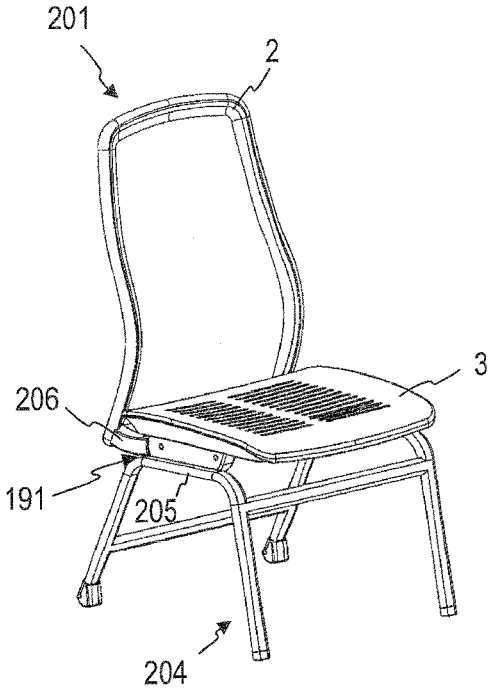
FIG. 18 is a perspective view of a health care chair having a tilt mechanism according to an embodiment.
Figure 19:
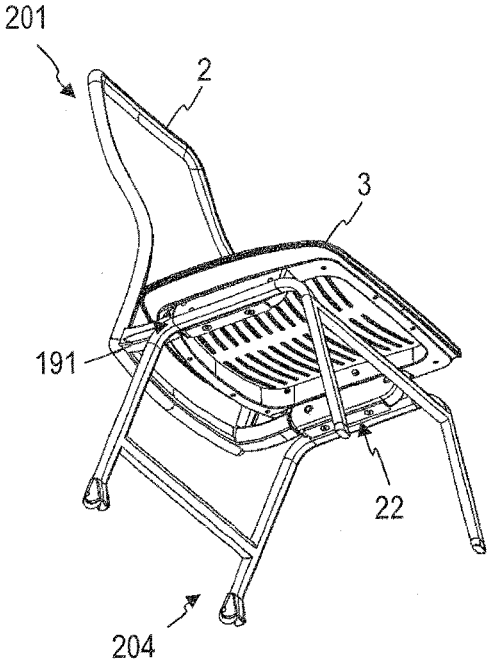
FIG. 19 is another perspective view of the chair of FIG. 18.
Figure 20:
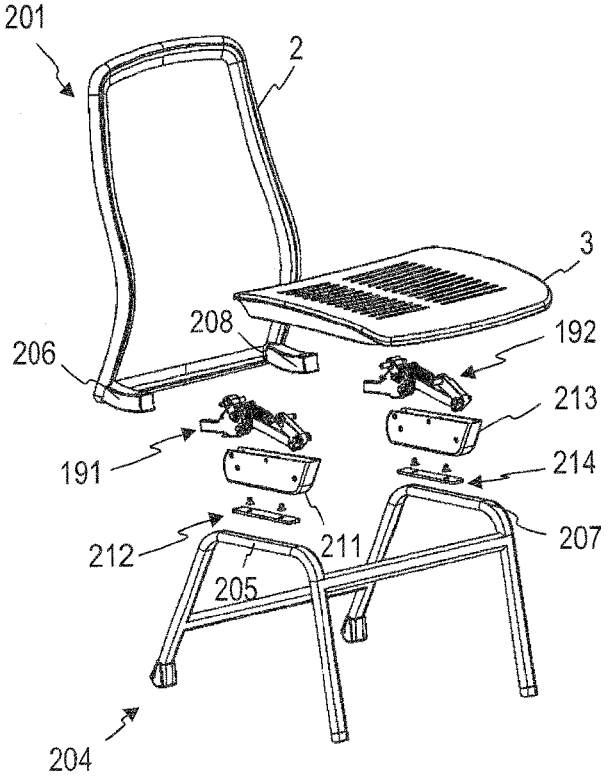
FIG. 20 is an exploded view of the chair of FIG. 18.

FIG. 18 and FIG. 19 are perspective views of a seating furniture implemented as a health care chair 201. FIG. 20 is an exploded view of the health care chair 201.

The health care chair 201 includes a frame 204 which may be formed from steel, for example. A first tilt mechanism 191 according to an embodiment is attached to a backrest 2 and a seat 3. The first tilt mechanism 191 may be received in a first carrier 211. The first carrier 211 may define a cavity in which at least a part of the first tilt mechanism 191 is received. The first carrier 211 may be mounted to an upper rail 205 of the frame 204 using fasteners 212, for example.

A second tilt mechanism 192 according to an embodiment is attached to the backrest 2 and the seat 3 of the chair 201. The second tilt mechanism 192 may be received in a second carrier 212. The second carrier 212 may define a cavity in which at least a part of the second tilt mechanism 192 is received. The second carrier 212 may be mounted to another upper rail 207 of the frame 204 using fasteners 214, for example.

The first tilt mechanism 191 and the second tilt mechanism 192 may respectively have a small lateral width. The width of the tilt mechanisms 191, 192 and/or of the carriers 211, 213 in which they are received may be comparable or even approximately equal to or less than a width of the upper rails 205, 207 of the frame 204. By mounting the first tilt mechanism 191 and the second tilt mechanism 192 between the frame 204 and the seat 3, and by coupling the first tilt mechanism 191 and the second tilt mechanism 192 to portions 206, 208 of the backrest 2, the health care chair 201 may be provided with weight-responsive recline characteristics.

Figure 21:
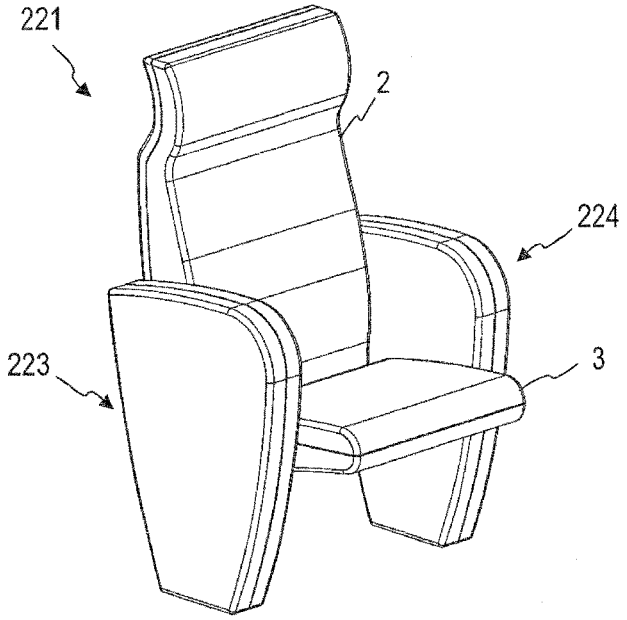
FIG. 21 is a perspective view of a cinema chair having a tilt mechanism according to an embodiment.
Figure 22:
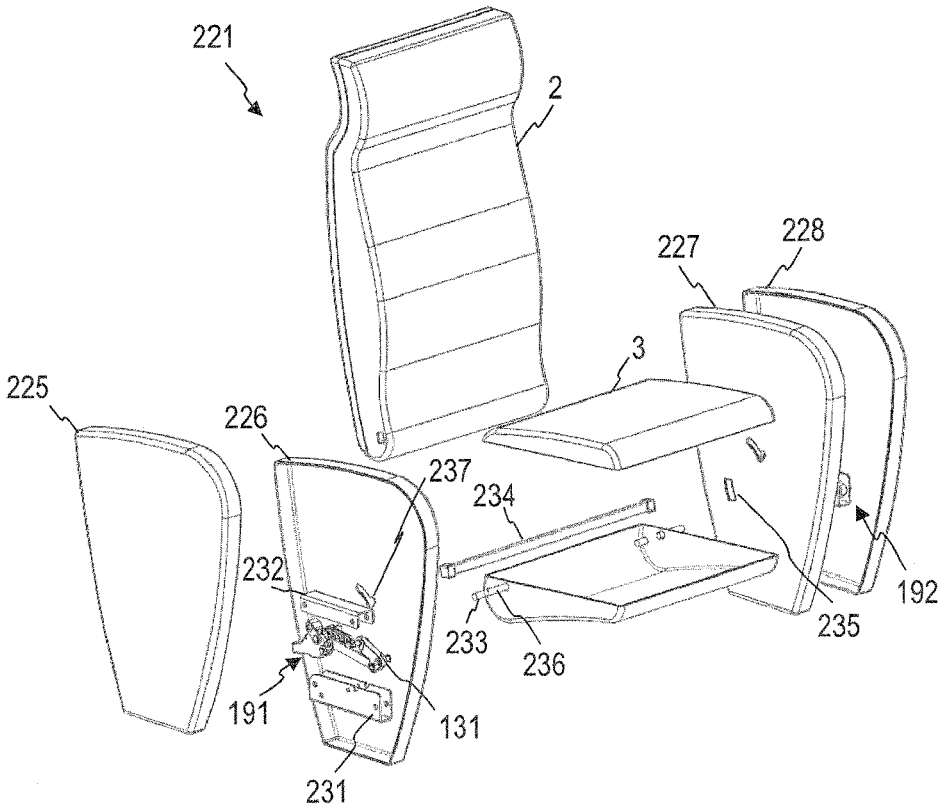
FIG. 22 is an exploded view of the chair of FIG. 21.

FIG. 21 is a perspective view of a seating furniture implemented as a cinema chair 221, for example. FIG. 22 is an exploded view of the cinema chair 221.

The cinema chair 221 includes a substructure which has a first side section 223 and a second side section 224 which support the chair 221 and act as substructure. No central support needs to be provided. A first tilt mechanism 191 according to an embodiment is attached to a backrest 2 and a seat 3. The first tilt mechanism 191 may be received within a cavity defined in the first side section 223. For illustration, the first side section 223 may include a first shell 225 and a second shell 226 attached to the first shell 225. The first tilt mechanism 191 may be received in the cavity between the first shell 225 and the second shell 226. A first carrier 231 may be arranged in, and may be fixedly attached to, the first side section 223. The first carrier 231 may define a cavity in which at least a part of the first tilt mechanism 191 is received.

A second tilt mechanism 192 according to an embodiment is attached to the backrest 2 and the seat 3. The second tilt mechanism 192 may be received within a cavity defined in the second side section 224. For illustration, the second side section 224 may include a first shell 227 and a second shell 228 attached to the first shell 227. The second tilt mechanism 192 may be received in the cavity between the first shell 227 and the second shell 228. A second carrier may be arranged in, and may be fixedly attached to, the second side section 224. The second carrier may define a cavity in which at least a part of the second tilt mechanism 192 is received.

The first tilt mechanism 191 and the second tilt mechanism 192 may respectively be attached to the seat 3 and the backrest 2 using suitable mounts 232, 233, 234. At least some of the mounts, e.g. a mounting bracket 232, may be arranged within the cavity of the side sections 223, 224. Passages 235 may be formed in an inner wall of the first side section 223 and an inner wall of the second side section 224 to allow at least some of the mounts 233, 234 to pass therethrough. By attaching the first tilt mechanism 191 and the second tilt mechanism 192 to the backrest 2 and the seat 3, the cinema chair 221 may be provided with weight-responsive recline characteristics. As will be explained in more detail with reference to FIG. 27 to FIG. 30 below, the first tilt mechanism 191 and the second tilt mechanism 192 may be configured in such a way that the seat 3 may be folded up.

It will be appreciated that the cinema chair 221 does not have a central support below the seat 3, and would normally be provided with a fixed chair back 2. The use of the first tilt mechanism 191 and the second tilt mechanism 192 allows the chair 221 to be provided with a weight-responsive recline characteristics. The first tilt mechanism 191 and the second tilt mechanism 192 may be integrated into the side sections 223, 224 so as to be hidden from view.

When several chairs of the type illustrated in FIG. 21 and FIG. 22 are arranged in a row, adjacent chairs may share a common side section 223, 224. In this case, two tilt mechanisms which are operative independent from each other may be arranged within one and the same side section, to accommodate independent recline movements of adjacent chairs.

Figure 23:
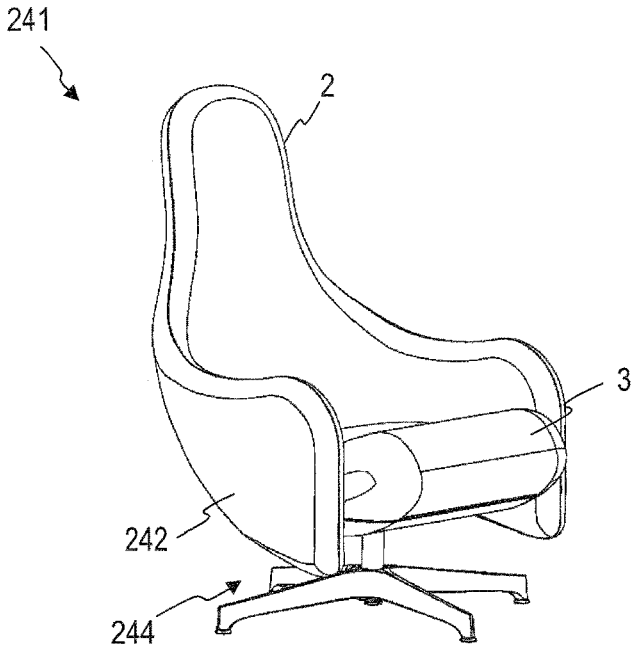
FIG. 23 is a perspective view of a domestic chair having a tilt mechanism according to an embodiment.
Figure 24:
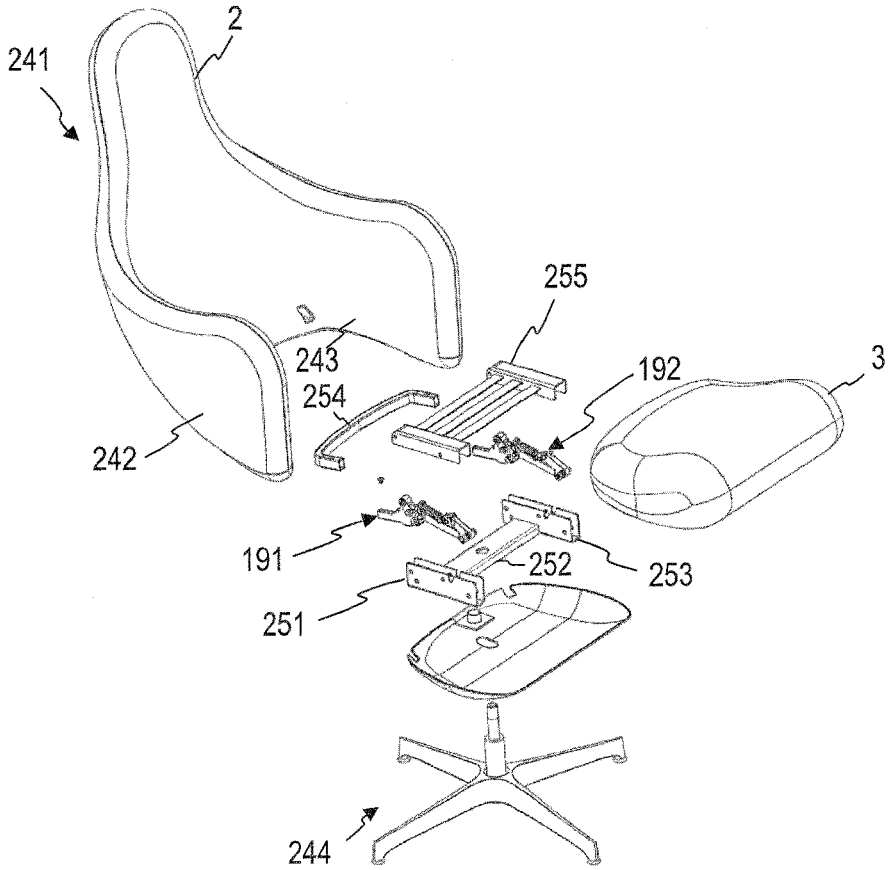
FIG. 24 is an exploded view of the chair of FIG. 23.

FIG. 23 is a perspective view of a seating furniture implemented as a domestic chair 241. FIG. 24 is an exploded view of the domestic chair 241.

The domestic chair 241 includes a substructure 24 which may have a central column. A base support may include a first carrier 251 for supporting a first tilt mechanism 191 and a second carrier 253 for supporting a second tilt mechanism 192. The first carrier 251 and the second carrier 253 may be interconnected by a transverse member 252. The first carrier 251, the second carrier 253, and the transverse member 252 may be integrally formed.

The first tilt mechanism 191 is attached to the backrest 2 and a seat 3. The first tilt mechanism 191 may be received in the first carrier 251. The first carrier 251 may define a cavity in which at least a part of the first tilt mechanism 191 is received. The second tilt mechanism 192 is attached to the backrest 2 and the seat 3. The second tilt mechanism 192 may be received in the second carrier 253. The second carrier 253 may define a cavity in which at least a part of the second tilt mechanism 193 is received.

In the assembled state of the domestic chair 241, the first carrier 251 with the first tilt mechanism 191 supported thereon may be located in a cavity of the seat 3 or a cavity of a side wing portion 242 which is integral with or otherwise attached to the backrest 2. The second carrier 253 with the second tilt mechanism 192 supported thereon may be located in another cavity of the seat 3 or a cavity of another side wing portion 243 which is integral with or otherwise attached to the backrest 2.

The first tilt mechanism 191 and the second tilt mechanism 192 may be attached to the seat 3 through a mount 255. The mount 255 may extend between the first tilt mechanism 191 and the second tilt mechanism 192. The first tilt mechanism 191 and the second tilt mechanism 192 may be attached to the backrest 2 through another mount 254, e.g. a bracket 254.

In the domestic chair 241 of FIG. 23 and FIG. 24, the tilt mechanism is applied to a type of chair which maintains a clean silhouette despite the presence of a tilting system. The tilt mechanism 191, 192 may be entirely hidden so as not to affect the design and appearance of the domestic chair 241.

Figure 25:
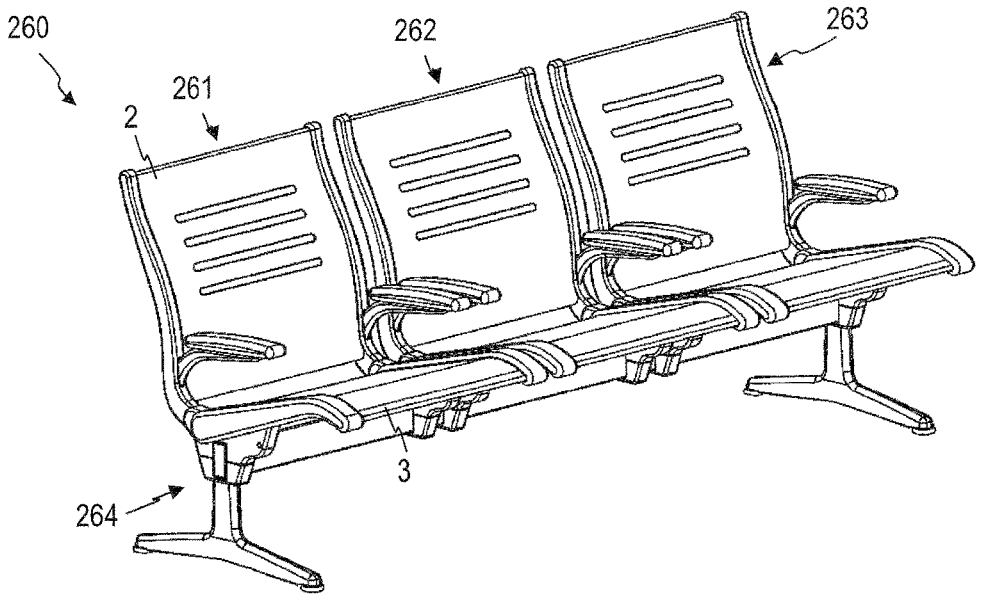
FIG. 25 is a perspective view of a public seating bench which includes a tilt mechanism according to an embodiment.
Figure 26:
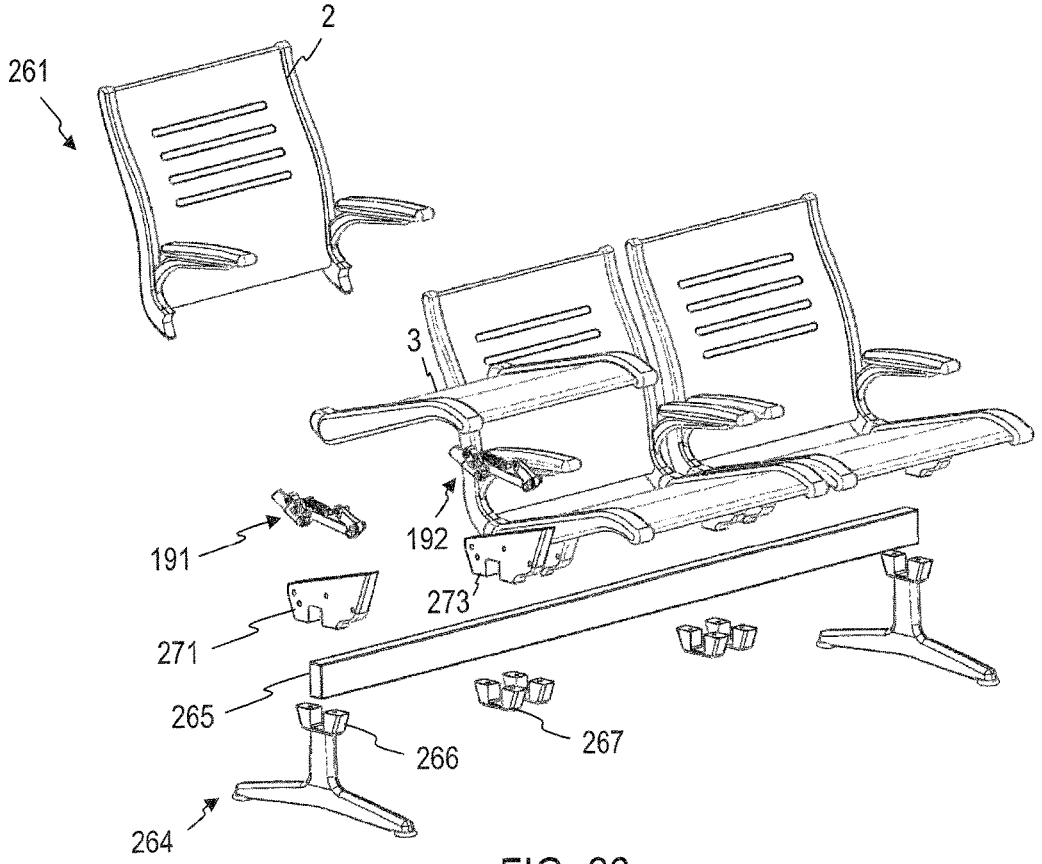
FIG. 26 is a partially exploded view of the bench of FIG. 25.

FIG. 25 is a perspective view of a public seating bench 260. FIG. 26 is a partially exploded view of the bench 260. The bench 260 or its seating units are examples for seating furniture provided with a tilt mechanism according to an embodiment.

The bench 260 may include one or several modular seating units 261, 262, 263. The modular seating units 261, 262, 263 may respectively have identical configurations. Each one of the modular seating units 261, 262, 263 included in the bench 260 may have a backrest 2 and a seat 3. The backrests and seats of the various seating units 261, 262, 263 may be independent from each other and may be movable independently from each other, e.g. during a recline motion.

The bench 260 has a substructure 264. The substructure 264 may include a strut 265 on which one or several seating units 261, 262, 263 are mounted. A first tilt mechanism 191 and a second tilt mechanism 192 according to an embodiment may be interposed between the strut 265 and each modular seating unit 261, 262, 263 which is provided with a weight-responsive recline mechanism 191, 192.

A first carrier 271 may be attached to the strut 265 using a mount 266. The strut 265 may be received in between the mount 266 and the first carrier 271. The first carrier 271 may define a first cavity in which at least a part of the first tilt mechanism 191 is received.

A second carrier 272 may be attached to the strut 265 using a mount 267. The strut 265 may be received in between the mount 267 and the second carrier 272. The second carrier 272 may define a second cavity in which at least a part of the second tilt mechanism 192 is received.

Both the first tilt mechanism 191 and the second tilt mechanism 192 may be attached to the backrest 2 of the same seating unit 261. Both the first tilt mechanism 191 and the second tilt mechanism 192 may be attached to the seat 3 of the same seating unit 261.

By mounting the first tilt mechanism 191 and the second tilt mechanism 192 between the strut 265 and the seat 3, and by coupling the first tilt mechanism 191 and the second tilt mechanism 192 to the backrest 2, the seating unit 261 of the bench 260 may be provided with weight-responsive recline characteristics.

When a bench 260 includes several seating units 261, 262, 263, each one of the seating units may be provided with a weight-responsive tilt mechanism configured as illustrated and explained with reference to the seating unit 261 in FIG. 26. In other embodiments, only a fraction of the seating units of a bench may be provided with a weight-responsive tilt mechanism. I.e., the bench 260 may include at least one seating unit having a weight-responsive tilt mechanism which includes at least one tilt mechanism according to an embodiment, and the bench 260 may optionally further include at least one seating unit which does not have a weight-responsive tilt mechanism.

The tilt mechanism configured for use in association with any one of the various seating furniture may be configured such that it allows the seat to be folded up. The tilt mechanism provides weight-responsive recline characteristics when a person sits on the seat, while allowing the seat to be folded up without displacing the backrest when no person sits on the seat. For illustration, the seat may be coupled to the third lever 33 or the third lever 133 via a further mount structure which allows the seat to pivot about the further mount structure of the third lever 33 or the third lever 133. The first lever 31, 131 may be coupled to the seat via a mount structure which includes an abutment surface attached to the first lever 31, 131 and an abutment feature attached to the seat 3. When the seat is folded up, the abutment feature may disengage from the abutment surface, as will be described in more detail with reference to FIG. 27 to FIG. 30 below. When the seat is folded down, the abutment feature may remain in abutting engagement with the abutment surface.

A tilt mechanism which allows the seat to be folded up may be desirable for a wide variety of seating furniture. For illustration, such a tilt mechanism may be desirable to allow people to pass by the seating furniture more easily. This may be desirable when the seat would otherwise be likely to obstruct a narrow passage, e.g. in cinema seating or in trains. For further illustration, such a tilt mechanism may be desirable to facilitate horizontal nesting of chairs. With the seats folded up, various chairs may be nested horizontally. This allows the chairs to be stored in a more compact way than with the seats folded down. The ability to pack the chairs more densely by horizontal nesting may be attractive for example for class room seating chairs or chairs for training classes.

Figure 27:
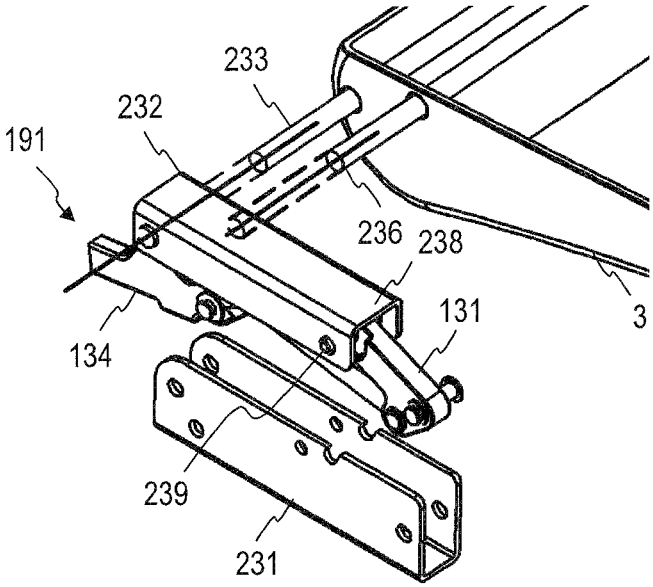
FIG. 27 is an enlarged partial exploded view of a tilt mechanism according to an embodiment.

FIG. 27 is an exploded view of a tilt mechanism 191 according to an embodiment. The tilt mechanism 191 may have a configuration of levers which may correspond to the configuration of levers explained with reference to FIG. 5 to FIG. 10. The tilt mechanism 191 may have a configuration of levers which may correspond to the configuration of levers explained with reference to FIG. 12 to FIG. 17.

The seat 3 may be coupled to a third lever 33, 133 of the tilt mechanism by a further mount structure 233, which may be configured as a pin or as another shaft. The further mount structure 233 may perform the function of the further mount structure 39, 139 explained with reference to FIG. 5 to FIG. 10 and with reference to FIG. 12 to FIG. 17.

The first lever 31, 131 of the tilt mechanism may be coupled to the seat 3 via a mount 232 and an abutment projection 236. The mount 232 and the abutment projection 236 form a mount structure for coupling the seat 3 to the first lever 31, 131. The abutment projection 236 may be formed as a pin provided on the seat 3. The mount 232 is attached to the first lever 31, 131. The mount 232 may be pivotably attached to the first lever 31, 131 by a connecting pin passing through the opening 38, 138, which is attached to the mount 232.

The mount 232 defines an abutment surface 238. When a person sits on the seat 3, the torque applied onto the seat 3 maintains the abutment projection 236 in abutting engagement with the abutment surface. Via the mount 232 and the abutment projection 236, a torque is exerted onto the first lever 31, 131 which provides weight-responsive recline characteristics when a person sits on the seat 3.

When no person sits on the seat 3, the abutment projection 236 can be disengaged from the abutment surface 238. The tilt mechanism 191 allows the seat 3 to be pivoted about the mount structure 233. This allows the seat 3 to be flipped upward.

Figure 28:
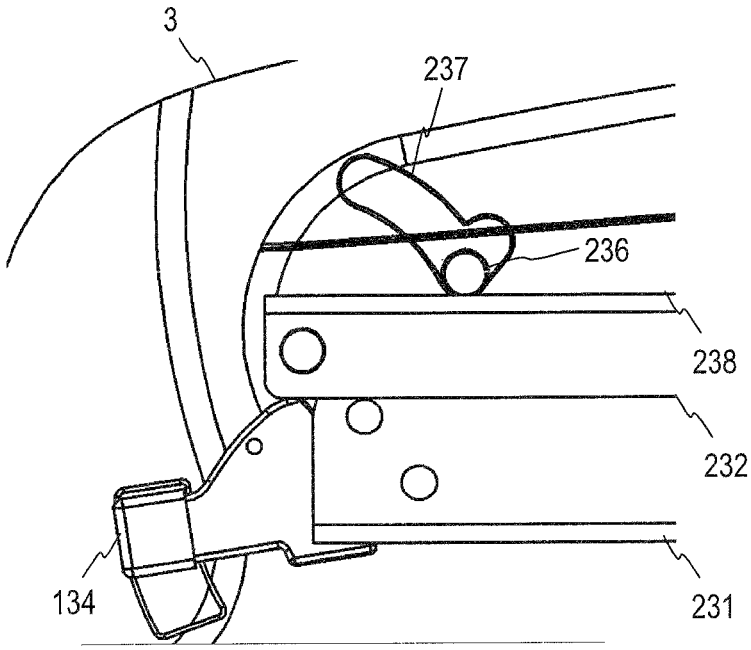
FIG. 28 is a side view of the tilt mechanism of FIG. 27 when a seat is folded down.
Figure 29:
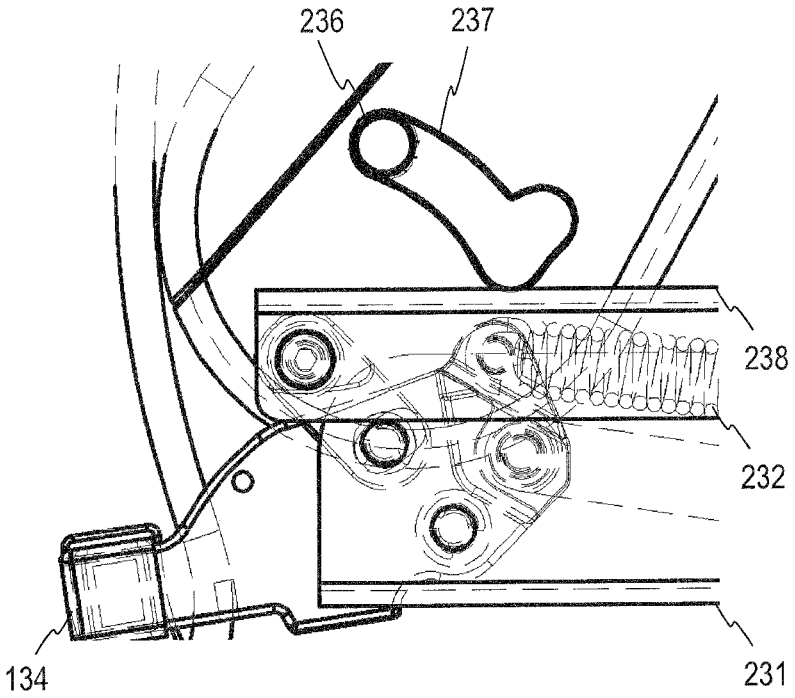
FIG. 29 is a side view of the tilt mechanism of FIG. 27 when the seat is folded up.
Figure 30:
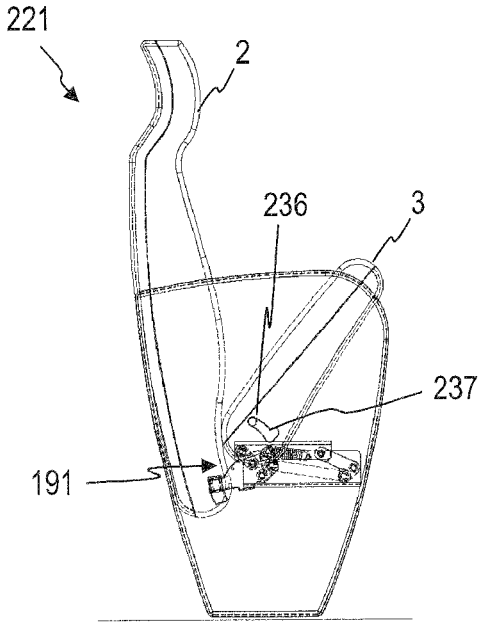
FIG. 30 is a side view of a seating furniture which includes the tilt mechanism of FIG. 27.

A guide recess 237, which is best seen in FIG. 28, FIG. 29, and FIG. 30 may be provided for guiding the abutment projection 236. The guide recess 237 may be formed in a side portion or a base structure of the seating furniture in which the tilt mechanism 191 is installed. When the seat 3 is flipped upward about the further mount structure 233 to fold up the seat 3, the abutment projection 236 is disengaged from the abutment surface 238. The abutment projection 236 may travel along the guide recess 237. When the seat 3 is flipped downward about the further mount structure 233, to fold down the seat 3, the abutment projection 236 travels downward along the guide recess 237 until it engages the abutment surface 238.

FIG. 28 shows the tilt mechanism 191 installed in a seating furniture in a state in which the seat 3 is folded down. FIG. 29 shows the tilt mechanism 191 installed in a seating furniture in a state in which the seat 3 is folded up. Hidden components of the tilt mechanism are shown in broken lines in FIG. 29.

FIG. 30 shows a cinema chair 221 which includes a weight-responsive tilt mechanism 191 which allows the seat 3 to be folded up. An end of the guide recess 237 may define an end stop for the travel of the seat 3, as illustrated in FIG. 30.

While the weight-responsive tilt mechanism 191 which allows the seat 3 to be folded up is illustrated installed in a cinema chair 221 in FIG. 30, the tilt mechanism 191 may be installed in a wide variety of other seating furniture, including office chairs, classroom chairs, public seating, public transportation seating, or training class chairs.

It will be appreciated that the tilt mechanism according to embodiments may be used in chairs and other seating furniture of various other kinds and types.

Various effects may be attained by tilt mechanisms of embodiments and seating furniture using the same. The tilt mechanisms may generally be used in pairs on the two sides of the seating furniture. The configuration of the tilt mechanism allows the tilt mechanism to have dimensions which are smaller than those of conventional weight-responsive tilt mechanisms.

The tilt mechanism can be used in different types of chairs, without the need of a central column and without limitation or expensive adaptations. The tilt mechanism can be used in a wide variety of other types of seating furniture.

The compact design allows the tilt mechanism to be partially or even completely hidden in a seat with ordinary thickness. The tilt mechanism allows the seating furniture, e.g. the chair, to be designed with supports for the backrest positioned on the sides. The tilt mechanism does not require a central connection located below a seat center, for example. The tilt mechanism is suitable for chairs having mesh seats or other elastic membranes.

When the backrest of the chair is tilted backward, a displacement of the seat slightly upwards and towards the front of the seating furniture may result, which is beneficial for ergonomic reasons and/or assists the user in maintaining the posture throughout a certain period.

The seating furniture may be easily adapted to provide different kinematics by varying the inclination of the third lever, e.g. by altering the position at which the third lever attaches to the seat.

The invention claimed is:

1. A pair of tilt mechanisms for a weight-responsive seating furniture, each tilt mechanism comprising:

a carrier having a U-shaped portion with parallel first and second wall sections that define a cavity;

a backrest support configured for coupling to a backrest, the backrest support being pivotably mounted to the carrier;

a first lever having a mount structure for coupling the first lever to a seat, the first lever being mounted to be pivotable about a first pivot axis to the carrier; and a second lever pivotably attached to the backrest support at a second pivot axis and being coupled to the first lever by a coupling mechanism to pivot the first lever about the first pivot axis when the backrest support pivots, wherein the backrest support is pivotably mounted to the carrier at a third pivot axis which is offset from the second pivot axis, wherein at least a portion of the first lever and at least a portion of the second lever extend into the cavity, wherein the coupling mechanism comprises a fourth pivot axis which pivotably couples the second lever to the first lever, and wherein the first lever of each tilt mechanism is attachable to the seat using the respective mount structure.

2. The pair of tilt mechanisms of claim 1, wherein the pair of tilt mechanisms are mirror-symmetric.

3. The pair of tilt mechanisms of claim 1, wherein each tilt mechanism further comprises:

a respective slot to limit travel of the seat.

4. The pair of tilt mechanisms of claim 3, wherein each tilt mechanism further comprises a projection received in the slot such that a relative displacement between the projection and the slot is effected when the backrest support pivots.

5. The pair of tilt mechanisms of claim 3, wherein the slot extends at a distance from the first pivot axis.

6. The pair of tilt mechanisms of claim 1, wherein each tilt mechanism further comprises an energy storage mechanism which biases at least one of the backrest support and the second lever.

7. The pair of tilt mechanisms of claim 1, further comprising:

a seating unit base support, wherein the first lever is pivotably mounted to the seating unit base support and wherein the backrest support is pivotably mounted to the seating unit base support.

8. The pair of tilt mechanisms of claim 7, wherein each tilt mechanism further comprises a third lever having a further mount structure for coupling the third lever to the seat, the third lever being mounted to the seating unit base support.

9. The pair of tilt mechanisms of claim 8, wherein the further mount structure allows the seat to pivot about the further mount structure.

10. The pair of tilt mechanisms of claim 1, wherein each tilt mechanism further comprises a third lever having a further mount structure for coupling the third lever to the seat, wherein the third lever is pivotably mounted to the carrier at the third pivot axis.

11. The pair of tilt mechanisms of claim 10, wherein the further mount structure allows the seat to pivot about the further mount structure.

12. A seating furniture, comprising:

a seat;

a backrest;

a first tilt mechanism coupled to a first portion of the seating furniture, and a second tilt mechanism coupled to a second portion of the seating furniture, wherein each of the first and second tilt mechanisms comprises:

a carrier having a U-shaped portion with parallel first and second wall sections that define a cavity, a backrest support configured for coupling to the backrest, the backrest support being pivotably mounted to the carrier, a first lever having a mount structure for coupling the first lever to the seat, the first lever being mounted to be pivotable about a first pivot axis to the carrier, and a second lever pivotably attached to the backrest support at a second pivot axis and being coupled to the first lever with a coupling mechanism that pivots the first lever about the first pivot axis when the backrest support pivots, wherein the backrest support is pivotably mounted to the carrier at a third pivot axis which is offset from the second pivot axis, wherein at least a portion of the first lever and at least a portion of the second lever extend into the cavity, and wherein the coupling mechanism comprises a fourth pivot axis which pivotably couples the second lever to the first lever, the first lever of the first tilt mechanism and the first lever of the second tilt mechanism are attached to the seat, and the backrest support of the first tilt mechanism and the backrest support of the second tilt mechanism are attached to the backrest.

13. The seating furniture of claim 12, wherein the first tilt mechanism and the second tilt mechanism are mirror-symmetric to one another, and wherein the first tilt mechanism and the second tilt mechanism are arranged on opposite lateral sides of the seating furniture.

* * * * *